US011512598B2

(12) United States Patent
Rathay et al.

(10) Patent No.: US 11,512,598 B2
(45) Date of Patent: Nov. 29, 2022

(54) COOLING ASSEMBLY FOR A TURBINE ASSEMBLY

(71) Applicant: General Electric Company, Schenectady, NY (US)

(72) Inventors: Nicholas William Rathay, Rock City Falls, NY (US); Travis Packer, Simpsonville, SC (US); Keith Lord, Taylor, SC (US); Jeffrey Jones, Simpsonville, SC (US); Jacob Kittleson, Greenville, SC (US); Gustavo Ledezma, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 20 days.

(21) Appl. No.: 16/324,447

(22) PCT Filed: Mar. 14, 2018

(86) PCT No.: PCT/US2018/022314
§ 371 (c)(1),
(2) Date: Feb. 8, 2019

(87) PCT Pub. No.: WO2019/177600
PCT Pub. Date: Sep. 19, 2019

(65) Prior Publication Data

US 2021/0355832 A1 Nov. 18, 2021

(51) Int. Cl.
*F01D 5/18* (2006.01)

(52) U.S. Cl.
CPC ..... *F01D 5/187* (2013.01); *F01D 5/181* (2013.01); *F05D 2250/185* (2013.01); *F05D 2260/201* (2013.01); *F05D 2260/2212* (2013.01)

(58) Field of Classification Search
CPC ..... F01D 5/18–189
See application file for complete search history.

(56) References Cited

U.S. PATENT DOCUMENTS 4,487,550 A 12/1984 Horvath et al.
6,164,914 A * 12/2000 Correia ..... F01D 5/186 415/173.1

(Continued)

FOREIGN PATENT DOCUMENTS

CN 106481366 A 3/2017
DE 19944923 A1 3/2001

(Continued)

OTHER PUBLICATIONS

Bohn et al., "3-D Internal Flow and Conjugate Calculations of a Convective Cooled Turbine Blade With Serpentine-Shaped and Ribbed Channels", The American Society of Mechanical Engineers, pp. 1-10, Jun. 7-10, 1999.

(Continued)

*Primary Examiner* — Christopher R Legendre
(74) *Attorney, Agent, or Firm* — Charlotte Wilson; James Pemrick; Hoffman Warnick LLC

(57) ABSTRACT

A cooling assembly comprises a coolant source chamber inside an airfoil that directs coolant inside the airfoil that extends between a hub end and a tip end that includes a tip body and tip rail along a radial length. A first body cooling chamber and a second body cooling chamber are disposed inside the tip body. The second body cooling chamber is positioned between the tip end and the first body cooling chamber. At least one of the first or second body cooling chambers are fluidly coupled with the coolant source chamber. The coolant source chamber directs the coolant into the first or second body cooling chambers. A rail cooling chamber disposed inside of the tip rail is fluidly coupled with the first or second body cooling chambers. The first or second (Continued)

body cooling chambers directs coolant out of the body cooling chambers and into the rail cooling chamber.

20 Claims, 10 Drawing Sheets

(56) References Cited

U.S. PATENT DOCUMENTS

| | | | | |
|---|---|---|---|---|
| 7,334,991 | B2 | 2/2008 | Liang | |
| 7,537,431 | B1 | 5/2009 | Liang | |
| 8,079,811 | B1 | 12/2011 | Liang | |
| 8,157,527 | B2 | 4/2012 | Piggush et al. | |
| 8,172,507 | B2 | 5/2012 | Liang | |
| 8,262,357 | B2 | 9/2012 | Mhetras | |
| 9,476,306 | B2 | 10/2016 | Bunker | |
| 10,436,040 | B2 * | 10/2019 | Rhodes | F01D 5/18 |
| 10,605,098 | B2 * | 3/2020 | Dyson | F01D 5/20 |
| 2014/0178207 | A1 | 6/2014 | He et al. | |
| 2015/0104327 | A1 | 4/2015 | Fouad et al. | |
| 2016/0265366 | A1 | 9/2016 | Snyder et al. | |
| 2017/0259462 | A1 | 9/2017 | Kottilingam et al. | |
| 2021/0355832 | A1 * | 11/2021 | Rathay | F01D 5/20 |

FOREIGN PATENT DOCUMENTS

| | | | | |
|---|---|---|---|---|
| EP | 1557533 | B1 | 3/2008 | |
| EP | 2071126 | A2 | 6/2009 | |
| EP | 3765714 | A1 | 1/2021 | |
| GB | 2279705 | A * | 1/1995 | F01D 5/187 |
| JP | S51014519 | A | 5/1974 | |
| JP | H06167201 | A | 6/1994 | |
| JP | 2001073704 | A | 3/2001 | |
| WO | 2012028584 | A1 | 3/2012 | |
| WO | 2016133487 | A1 | 8/2016 | |
| WO | 2019177600 | A1 | 9/2019 | |

OTHER PUBLICATIONS

Sunden et al., "Gas Turbine Blade Tip Heat Transfer and Cooling: A Literature Survey", Heat Transfer Engineering, vol. 31, Issue: 7, pp. 527-554, Oct. 12, 2011.

International Search Report and Written Opinion issued in connection with corresponding PCT application No. PCT/US2018/022314 dated Oct. 4, 2018.

Office Action issued in connection with corresponding JP application No. 2020-544905, dated Jan. 5, 2022, 13 pages.

Search Report issued in connection with corresponding JP application No. 2020-544905, dated Dec. 31, 2021, 40 pages.

* cited by examiner

COOLING ASSEMBLY FOR A TURBINE ASSEMBLY

FIELD

The subject matter described herein relates to cooling assemblies for equipment such as turbine airfoils.

BACKGROUND

The turbine assembly can be subjected to increased heat loads when an engine is operating. To protect the turbine assembly components from damage, cooling fluid may be directed in and/or onto the turbine assembly. Component temperature can be managed through a combination of impingement cooling, cooling flow through passages in the components, and film cooling with the goal of balancing component life and turbine efficiency. Improved efficiency can be achieved through increasing firing temperatures, reducing the volume of cooling flow, or a combination.

One issue with cooling known turbine assemblies is inadequate internal cooling of the tips and rails of turbine blades. The rail at the tip end of the turbine blade is subjected to high heat loads, making the tip end of the airfoil one of the hottest regions of the turbine blade. External tip flow fields are excessively chaotic which may require an excessive amount of cooling fluid in order to reduce the total heat load of the turbine blade. Therefore, an improved system may provide improved cooling coverage and improved cooling potential inside of the airfoil, and thereby reduce the average and/or local internal temperature of critical portions of the airfoil, enable more efficient operation of the engine, and/or improve the life of the turbine machinery.

BRIEF DESCRIPTION

In one embodiment, a cooling assembly comprises a coolant source chamber disposed inside an airfoil of a turbine assembly. The coolant source chamber is configured to direct coolant inside the airfoil of the turbine assembly. The airfoil extends between a hub end of the airfoil and a tip end of the airfoil along a radial length of the airfoil. The tip end of the airfoil includes a tip body and a tip rail. The cooling assembly includes a first body cooling chamber and a second body cooling chamber disposed inside the tip body of the airfoil. At least a portion of the second body cooling chamber is positioned between the tip end and the first body cooling chamber along the radial length of the airfoil. At least one of the first or second body cooling chambers are fluidly coupled with the coolant source chamber. The coolant source chamber is configured to direct at least some of the coolant into one or more of the first or second body cooling chambers. The cooling assembly also includes a rail cooling chamber disposed inside of the tip rail of the airfoil. The rail cooling chamber is fluidly coupled with at least one of the first or second body cooling chambers. The at least one of the first or second body cooling chambers is configured to direct at least some of the coolant out of the at least one first or second body cooling chambers and into the rail cooling chamber.

In one embodiment, a cooling assembly comprises a coolant source chamber disposed inside an airfoil of a turbine assembly. The coolant source chamber is configured to direct coolant inside the airfoil of the turbine assembly. The airfoil extends between a hub end of the airfoil and a tip end of the airfoil along a radial length of the airfoil. The tip end of the airfoil includes a tip body and a tip rail. The cooling assembly includes a first body cooling chamber and a second body cooling chamber disposed inside the tip body of the airfoil. At least a portion of the second body cooling chamber is positioned between the tip end and the first body cooling chamber along the radial length of the airfoil. At least one of the first or second body cooling chambers are fluidly coupled with the coolant source chamber. The coolant source chamber is configured to direct at least some of the coolant into one or more of the first or second body cooling chambers. The cooling assembly also includes a rail cooling chamber disposed inside of the tip rail of the airfoil. The rail cooling chamber is fluidly coupled with at least one of the first or second body cooling chambers. The at least one of the first or second body cooling chambers is configured to direct at least some of the coolant out of the at least one first or second body cooling chambers and into the rail cooling chamber. One or more exhaust channels are fluidly coupled with the one or more of the rail cooling chamber or one or more of the first or second body cooling chambers. The one or more exhaust channels are configured to direct at least some of the coolant out of the airfoil.

In one embodiment, a method comprises fluidly coupling at least one of a first body cooling chamber or a second body cooling chamber with a coolant source chamber disposed inside the airfoil. The first body cooling chamber and the second body cooling chamber are disposed inside a tip body of the airfoil. The airfoil extends between a hub end of the airfoil and a tip end of the airfoil along a radial length of the airfoil. The tip end of the airfoil includes the tip body and a tip rail. The coolant source chamber is configured to direct coolant out of the coolant source chamber and into the at least one of the first or second body cooling chambers. At least a portion of the second body cooling chamber is positioned between the tip end and the first body cooling chamber along the radial length of the airfoil. The method also includes fluidly coupling a rail cooling chamber disposed inside the tip rail of the airfoil with at least one of the first or second body cooling chambers. The at least one of the first or second body cooling chambers are configured to direct at least some of the coolant out of the first or second body cooling chambers and into the rail cooling chamber.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein relate to systems and methods that effectively cool a tip end of a turbine airfoil. Rails at the tip ends of turbine airfoils are used to help reduce aerodynamic losses and therefore increase the efficiency of the turbine assembly. The tip end of the airfoil is subjected to high heat loads and is difficult to effectively cool. The systems and methods fluidly couple a coolant source chamber with at least one of two or more body cooling chambers, and fluidly couple at least one of the two or more body cooling chambers with one or more rail cooling chambers inside the tip end of the airfoil. For example, coolant or cooling fluid may be directed from inside the coolant source chamber, through two or more body cooling chambers and through one or more rail cooling chambers in order to effectively cool the internal temperature of the tip end of the airfoil. One technical effect of the subject matter herein is increasing the effectiveness of cooling the interior of the tip end of the airfoil. For example, directing the coolant through the plural cooling chambers inside a tip body and inside a tip rail of the tip end of the airfoil improves the increase of potential heat transfer inside the airfoil. One technical effect of the subject matter herein is improved cooling that may reduce airfoil temperatures with reduced coolant flow or volume and therefore extend part life and reduce unplanned outages.

Figure 1:
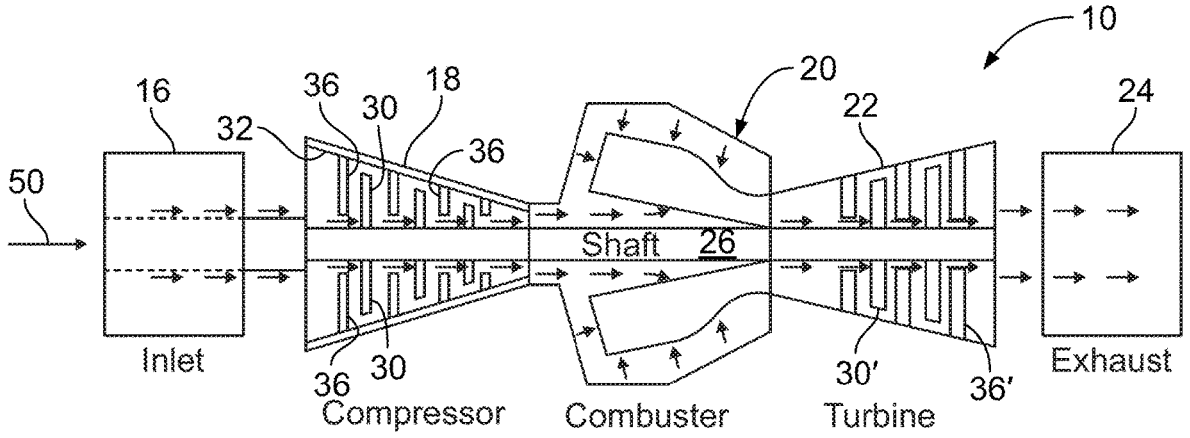
FIG. 1 illustrates a turbine assembly in accordance with one embodiment.

FIG. 1 illustrates a turbine assembly 10 in accordance with one embodiment. The turbine assembly 10 includes an inlet 16 through which air enters the turbine assembly 10 in the direction of arrow 50. The air travels in a direction 50 from the inlet 16, through a compressor 18, through a combustor 20, and through a turbine 22 to an exhaust 24. A rotating shaft 26 runs through and is coupled with one or more rotating components of the turbine assembly 10.

The compressor 18 and the turbine 22 comprise multiple airfoils. The airfoils may be one or more of blades 30, 30' or guide vanes 36, 36'. The blades 30, 30' are axially offset from the guide vanes 36, 36' in the direction 50. The guide vanes 36, 36' are stationary components. The blades 30, 30' are operably coupled with and rotate with the shaft 26.

Figure 2:
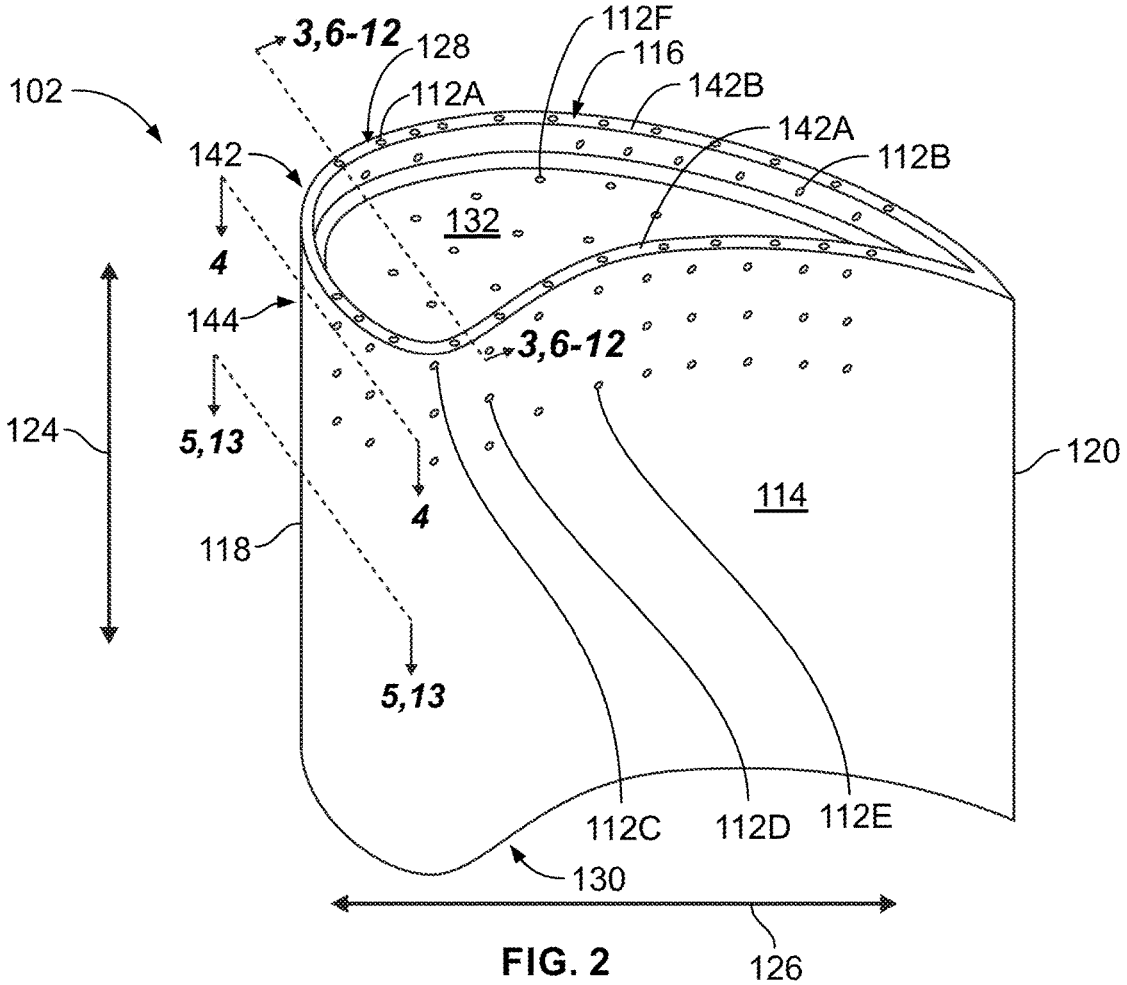
FIG. 2 illustrates a perspective view of an airfoil in accordance with one embodiment.

FIG. 2 illustrates a perspective view of an airfoil 102 of the turbine assembly 10 of FIG. 1 in accordance with one embodiment. The airfoil 102 may be a turbine blade used in the turbine assembly 10. The airfoil 102 has a pressure side 114 and a suction side 116 that is opposite the pressure side 114. The pressure side 114 and the suction side 116 are interconnected by a leading edge 118 and a trailing edge 120 that is opposite the leading edge 118. The pressure side 114 is generally concave in shape, and the suction side 116 is generally convex in shape between the leading and trailing edges 118, 120. For example, the generally concave pressure side 114 and the generally convex suction side 116 provides an aerodynamic surface over which compressed working fluid flows through the turbine assembly 10.

The airfoil 102 extends an axial length 126 between the leading edge 118 and the trailing edge 120. Optionally, the axial length 126 may be referred to as a chordwise length between the leading and trailing edges 118, 120. The airfoil 102 extends a span-wise length or radial length 124 between a tip end 128 and a hub end 130. For example, the axial length 126 is generally perpendicular to the radial length 124. In one or more embodiments, the hub end 130 may be operably coupled with the rotating shaft 26 of the turbine assembly 10, and the airfoil 102 extends a distance away from the rotating shaft 26 along the radial length 124 of the airfoil 102.

The tip end 128 of the airfoil 102 has a tip rail 142 and a tip body 144. The tip rail 142 is a blade tip rail commonly referred to as a squealer tip. The tip rail 142 includes a pressure side tip rail 142A and a suction side tip rail 142B, respectively positioned on the pressure and suction sides 114, 116 of the airfoil 102. For example, the pressure side tip rail 142A may extend at least partially along the perimeter of the pressure side 114 between the leading edge 118 and the trailing edge 120 of the airfoil 102, and the suction side tip rail 142B may extend at least partially along the perimeter of the suction side 116 between the leading edge 118 and the trailing edge 120 of the airfoil 102. Optionally, the tip rail 142 may extend along the perimeter of only one of the pressure side 114 or suction side 116. Optionally, the tip rail 142 may extend along the pressure and suction sides 114, 116, with one or more tip rails extending between the pressure and suction sides 114, 116 and between the leading edge 118 and the trailing edge 120.

The airfoil 102 has a tip floor surface 132 near the tip end 128 that extends between the pressure side 114 and the suction side 116 of the airfoil 102. The pressure side rail 142A extends radially outwardly from the tip floor surface 132 and extends between the leading edge 118 and the trailing edge 120 along the axial length 126 of the airfoil 102. For example, the pressure side tip rail 142A extends a distance away from the tip floor surface 132 along the radial length 124 of the airfoil 102. The path of the pressure side tip rail 142A is adjacent to or near the outer radial edge of the pressure side 114 such that the pressure side tip rail 142A aligns with the outer radial edge of the pressure side 114. The suction side tip rail 142B extends radially outward from the tip floor surface 132 and extends between the leading edge 118 and the trailing edge 120 along the axial length 126 of the airfoil 102. For example, the suction side tip rail 142B extends a distance away from the tip floor surface 132 along the radial length 124 of the airfoil 102. The path of the suction side tip rail 142B is adjacent to or near the outer radial edge of the suction side 116 of the airfoil 102 such that the suction side tip rail 142B aligns with the outer radial edge of the suction side 116. Optionally, the pressure side tip rail 142A and the suction side tip rail 142B may follow an alternative profile between the leading edge 118 and the trailing edge 120 along the axial length 126 of the airfoil 102. For example, the pressure side tip rail 142A and/or the suction side tip rail 142B may be moved a distance away from the outer radial edge of the pressure or suction sides 114, 116, respectively.

A plurality of exhaust holes 112 may be provided at the tip end 128 of the airfoil 102. In the illustrated embodiment, the airfoil 102 includes a plurality of top rail exhaust holes 112*a*, inside rail exhaust holes 112*b*, and outside rail exhaust holes 112*c* disposed at the tip rail 142 of the tip end 128. The rail exhaust holes 112*a*, 112*b*, 112*c* may be disposed at substantially equal or other predetermined distances apart from each other along the tip rail 142 between the leading edge 118 and the trailing edge 120. Additionally, the airfoil 102 may include a plurality of body exhaust holes 112*d*, a plurality of source exhaust holes 112*e*, and a plurality of tip floor exhaust holes 112*f* that are disposed at the tip body 144 of the tip end 128. The body exhaust holes 112*d* and the source exhaust holes 112*e* are disposed at substantially equal or other predetermined distances apart from each other along at least one of the pressure side 114 and suction side 116 (not shown) between the leading edge 118 and the trailing edge 120. Optionally, the airfoil 102 may include any number of tip rail exhaust holes, body exhaust holes, tip floor exhaust holes, and/or source exhaust holes that may be disposed at uniform or non-uniform distances apart from each other (e.g., in a patterned configuration, random configuration, or a combination of patterned and random, or the like). The exhaust holes 112 may have any common and/or unique shapes and/or sizes, or any combination therein. Additionally or alternatively, the airfoil 102 may include any number of exhaust holes disposed along the leading edge 118 and/or of the trailing edge 120 along the radial length 124 of the airfoil 102.

Figure 3:
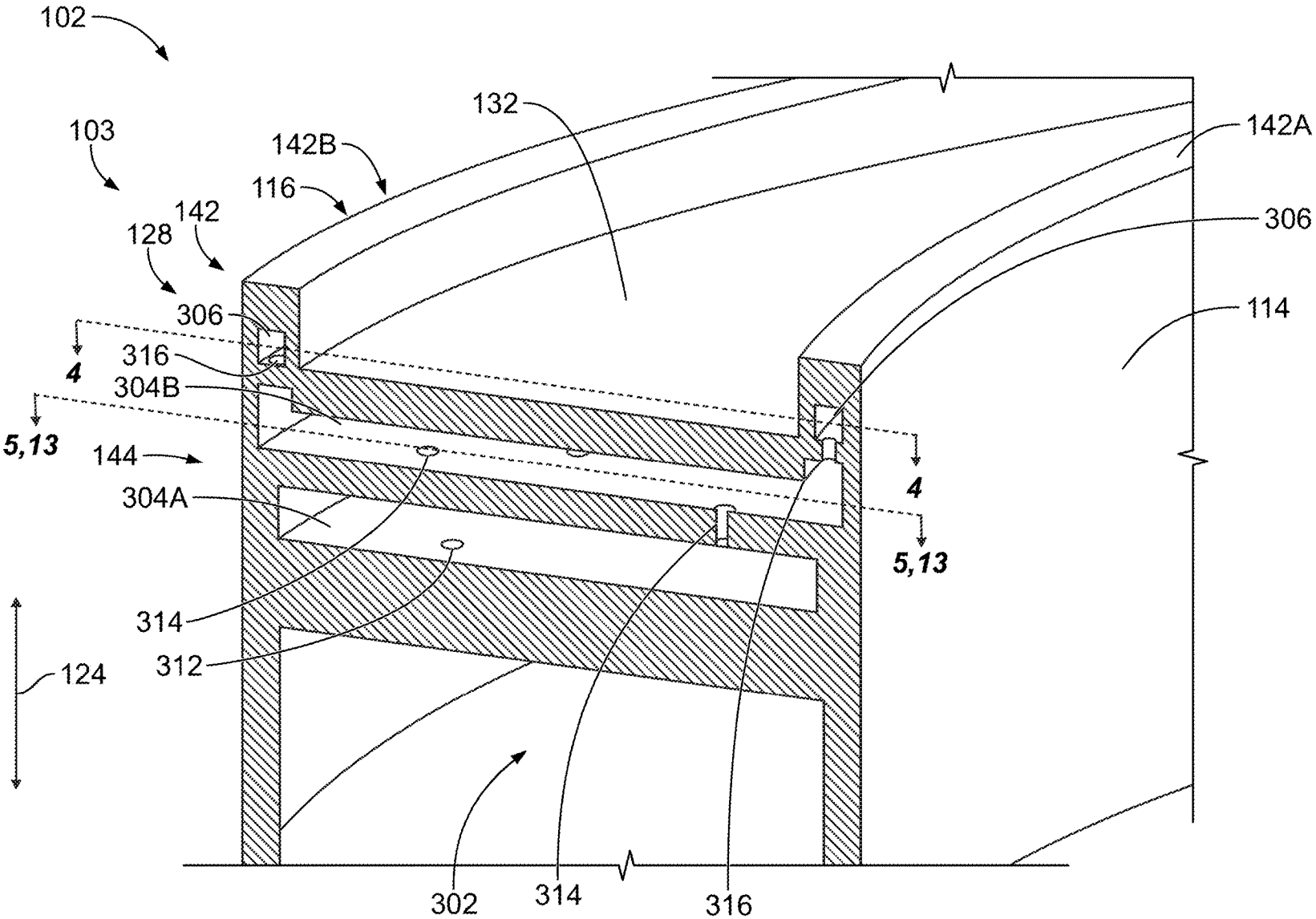
FIG. 3 illustrates a partial cross-sectional perspective view of an airfoil in accordance with one embodiment.

FIG. 3 illustrates a partial cross-sectional perspective view of a section 3, 6-12-3, 6-12 of the airfoil 102 in accordance with one embodiment. The airfoil 102 includes a cooling assembly 103 that is disposed at the tip end 128 of the airfoil 102 along the radial length 124 of the airfoil 102. In the illustrated embodiment of FIG. 3, the cooling assembly 103 includes two body cooling chambers 304A, 304B and a rail cooling chamber 306. Optionally, the cooling assembly 103 may include more than two body cooling chambers 304A, 304B, more than one rail cooling chamber 306, or any combination therein. Alternative embodiments of the cooling assembly 103 will be discussed in more detail below.

The body cooling chambers 304A, 304B are disposed inside of the tip body 144 of the airfoil 102. The body cooling chambers 304A, 304B are entirely contained within the tip body 144 of the airfoil 102. In the illustrated embodiment, a second body cooling chamber 304B is disposed proximate to the tip floor surface 132 relative to a first body cooling chamber 304A. For example, at least a portion of the second body cooling chamber 304B is positioned between the tip floor surface 132 and the first body cooling chamber 304A along the radial length 124 of the airfoil 102. Optionally, the first and second body cooling chambers 304A, 304B may be arranged in any alternative configuration inside of the tip body 144 of the airfoil 102. Additionally or alternatively, the cooling assembly 103 may include any number of body cooling chambers 304 disposed inside of the tip body 144 of the airfoil 102 and/or arranged in any configuration inside of the airfoil 102.

The rail cooling chamber 306 is disposed inside of the tip rail 142 of the airfoil 102 and extends along the pressure side tip rail 142A and the suction side tip rail 142B as a unitary rail cooling chamber 306. In the illustrated embodiment, the rail cooling chamber 306 is entirely contained within the tip rail 142 of the airfoil 102. For example, the rail cooling chamber 306 extends along the pressure side 114 of the airfoil 102 inside of the pressure side tip rail 142A, and extends along the suction side 116 of the airfoil 102 inside of the suction side tip rail 142B. Optionally, the rail cooling chamber 306 may extend between the tip body 144 and the tip rail 142 of the airfoil 102. Additionally or alternatively, the cooling assembly 103 may include two or more rail cooling chambers 306 disposed inside of the tip rail 142 of the airfoil 102, disposed inside a portion of the tip body 144 and inside the tip rail 142, or any combination therein. For example, the cooling assembly 103 may include a pressure side rail cooling chamber that is separate from a different, suction side rail cooling chamber, may include two or more rail cooling chambers that both extend at least partially along the pressure side tip rail 142A and the suction side tip rail 142B as two, unitary rail cooling chambers 306, or the like.

The cooling assembly 103 also includes a coolant source chamber 302 that is entirely contained inside of the airfoil 102. The coolant source chamber 302 is disposed at a position proximate to the hub end 130 relative to the body cooling chambers 304 and the rail cooling chamber 306 along the span-wise or radial length 124. In the illustrated embodiment, the coolant source chamber 302 is a single cooling chamber that extends in a span-wise direction along the axial length 126 (of FIG. 1) and along the radial length 124 (not shown). Optionally, the cooling assembly 103 may include any number of coolant source chambers 302. For example, the cooling assembly 103 may include one or more coolant source chambers that may extend in the span-wise direction, or may be complex cooling circuits having multiple features such as passages, channels, inlets, outlets, ribs, pin banks, circuits, sub-circuits, film holes, plenums, mesh, turbulators, or the like.

The coolant source chamber 302 is fluidly coupled with one or more inlet passages (not shown) proximate to the hub end 130 of the airfoil 102 along the radial length 124. The inlet passages may direct coolant from a location outside of the airfoil 102 into the coolant source chamber 302. For example, the coolant may be directed into the coolant source chamber 302 to cool the airfoil 102 and/or manage the temperature of the airfoil 102 or to manage the temperature of one or more components or features of the airfoil 102 of the turbine assembly 10.

The first body cooling chamber 304A is fluidly coupled with the coolant source chamber 302 via one or more source coolant channels 312 extending between the coolant source chamber 302 and the first body cooling chamber 304A. For example, the coolant source chamber 302 directs at least some of the coolant inside of the coolant source chamber 302 through the one or more source coolant channels 312 and into the first body cooling chamber 304A in order to cool the first body cooling chamber 304A. Optionally, the coolant source chamber 302 may be fluidly coupled with both the first and second body cooling chambers 304A, 304B such that the coolant source chamber 302 may direct coolant into the first and second body cooling chambers 304A, 304B. For example, one or more source coolant channels 312 may be fluidly coupled with the second body cooling chamber 304B, and one or more different source coolant channels 312 may be fluidly coupled with the first body cooling chamber 304A. Optionally, the coolant source chamber 302 may be fluidly coupled to any number of body cooling chambers 304 with plural source coolant channels 312. The source coolant channels 312 may be disposed at any location inside of the airfoil 102 and have variations in orientation, shape and diameter, such as, for example, circular, oval, elliptical, frustroconical, rectangular or angular, in order to control the direction, the pressure, the amount (e.g., volume), or the like, of the coolant that is directed into the first body cooling chamber 304A from the coolant source chamber 302 in order to control the temperature of one or more surfaces inside of the airfoil 102.

The first body cooling chamber 304A is fluidly coupled to the second body cooling chamber 304B via one or more body coolant channels 314 extending between the second body cooling chamber 304B and the first body cooling chamber 304A. For example, the first body cooling chamber 304A directs at least some of the coolant from inside of the first body cooling chamber 304A through the one or more body coolant channels 314 and into the second body cooling chamber 304B in order to cool the second body cooling chamber 304B. Optionally, the second body cooling chamber 304B may be fluidly coupled with the coolant source chamber 302 and may not be fluidly coupled with the first body cooling chamber 304A.

The rail cooling chamber 306 is fluidly coupled to the second body cooling chamber 304B with via one or more rail coolant channels 316 extending between the second body cooling chamber 304B and the rail cooling chamber 306. For example, the second body cooling chamber 304B directs at least some of the coolant from inside of the second body cooling chamber 304B through the one or more rail coolant channels 316 and into the rail cooling chamber 306 in order to cool the rail cooling chamber 306. In the illustrated embodiment, the rail coolant channels 316 fluidly couple the second body cooling chamber 304B with the rail cooling chamber 306 inside of the pressure side tip rail 142A and inside of the suction side tip rail 142B. Optionally, the rail coolant channels 316 may fluidly couple the second body chamber 304B with the rail cooling chamber 306 inside the pressure side tip rail 142A and may not fluidly coupled the second body chamber 304B with the rail cooling chamber 306 inside the suction side tip rail 142B. Additionally or alternatively, the rail cooling chamber 306 may be fluidly coupled with the first body cooling chamber 304A and fluidly coupled with the second body cooling chamber 304B. For example, one or more rail coolant channels 316 may direct coolant from the first body cooling chamber 304A to the rail cooling chamber 306, and one or more other rail coolant channels 316 may direct coolant from the second body cooling chamber 304B to the rail cooling chamber 306. Optionally, the rail cooling chamber 306 may be fluidly coupled with the coolant source chamber 302. Optionally, one or more of the rail cooling chambers 306, the first and/or second body cooling chambers 304A, 304B, or the coolant source chamber 302 may be fluidly coupled with any other cooling chambers in any configuration.

In the illustrated embodiment, the rail cooling chamber 306 has a rectangular cross-sectional shape. Optionally, at least portions of the rail cooling chamber 306 may have a non-rectangular cross-sectional shape, such as, for example, circular, oval, chevron, hourglass, diamond, sinusoidal or wavy, and/or sawtooth. Optionally, the width, height, shape, and/or volume of the cooling chamber 306 may vary along its axial length.

Figure 4:
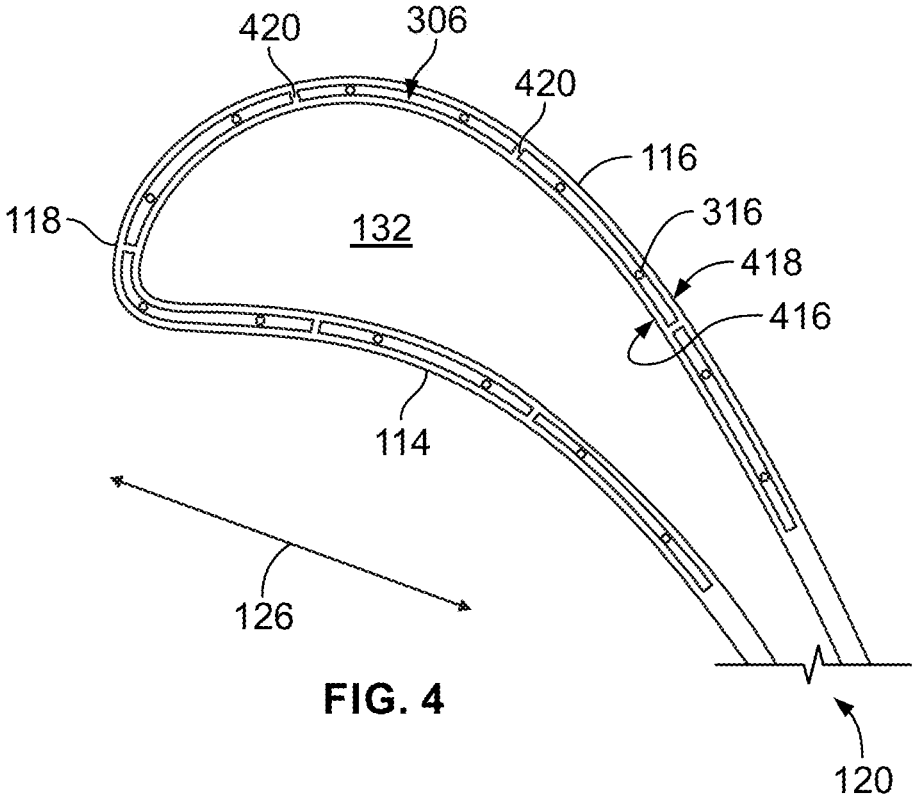
FIG. 4 illustrates a cross-sectional top view of the airfoil of FIG. 3 in accordance with one embodiment.

FIG. 4 illustrates a detailed a cross-sectional top view of a section 4-4 of FIG. 3 in accordance with one embodiment. The section 4-4 extends through the rail cooling chamber 306 in a span-wise direction along the axial length 126 of the airfoil 102. The tip rail 142 extends along the perimeter of the pressure side 114 and the suction side 116 of the airfoil 102 between the leading and trailing edges 118, 120. The tip rail 142 includes a rail inner surface 416 and a rail outer surface 418. The rail inner surface 416 extends along the perimeter of the tip rail 142 and is disposed facing a direction towards the tip floor surface 132. Additionally, the rail outer surface 418 extends along the perimeter of the tip rail 142 and is disposed facing a direction away from the tip floor surface 132. For example, the rail inner surface 416 faces a direction towards the interior of the airfoil 102, and the rail outer surface 418 faces in a direction away from the airfoil 102.

The rail cooling chamber 306 is disposed inside of the tip rail 142 between the rail inner surface 416 and the rail outer surface 418 extending along the perimeter of the airfoil 102. The rail cooling chamber 306 includes plural partitions 420 that extend between the rail inner and outer surfaces 416, 418 and are disposed at uniform distances apart from each other along the tip rail 142. The partitions 420 may be walls, turbulators, extensions, or the like, that may partially, substantially, entirely, or the like, separate and seal the rail cooling chamber 306 into plural rail cooling chambers 306. For example, the partitions 420 may reduce an amount or substantially prevent coolant from flowing from one rail cooling chamber to a different rail cooling chamber.

In the illustrated embodiment, the rail cooling chamber 306 includes six partitions 420 in which each partition is disposed at substantially uniform distances apart from each other partition 420. The partitions 420 are disposed such two rail coolant channels 316 are disposed in between each partition 420. Optionally, the rail cooling chamber 306 may include any number of partitions 420 that may be spaced uniformly or non-uniformly apart from each other with any number of rail coolant channels 316 disposed between partitions 420. Optionally, the rail cooling chamber 306 may not include any partitions 420 along the pressure side tip rail 142A, may not include any partitions 420 along the suction side tip rail 142B, may include any number of partitions 420 and coolant channels 316 disposed along the pressure side and/or suction side tip rail 142A, 142B, or any combination therein. For example, the partitions 420 and/or the rail coolant channels 316 may be disposed at any location along the tip rail 142 inside of the rail cooling channel 306 in order to control the direction, the amount (e.g., volume), or the like, of coolant that is directed into the rail cooling chamber 306 from the second body cooling chamber 306B (of FIG. 3) in order to control the temperature of one or more surfaces inside of the airfoil 102.

Figure 5:
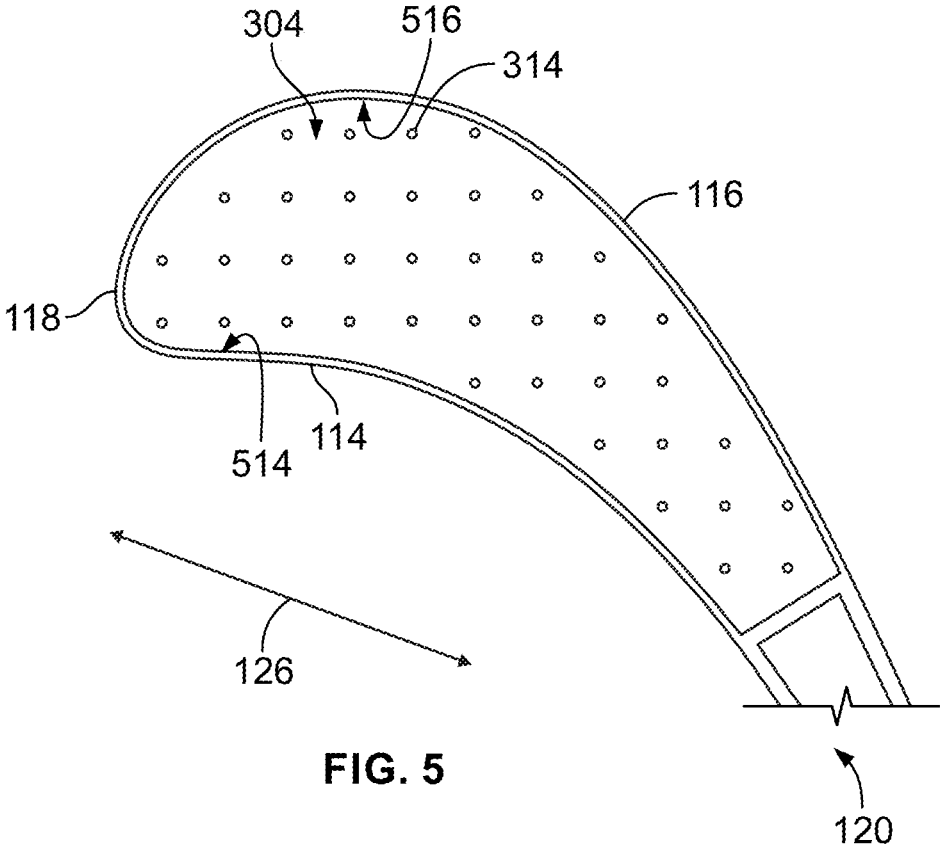
FIG. 5 illustrates a cross-sectional top view of the airfoil of FIG. 3 in accordance with one embodiment.

FIG. 5 illustrates a detailed cross-sectional top view of a section 5, 13-5, 13 of FIG. 3 in accordance with one embodiment. The section 5, 13-5, 13 extends through the second body cooling chamber 304B in a span-wise direction along the axial length 126 of the airfoil 102. While only the details of the cross-sectional view of the second body cooling chamber 304B are illustrated, the first body cooling chamber 304A may have the same or a substantially similar configuration as the second body cooling chamber 304B.

The airfoil 102 includes a pressure side inner surface 514 and a suction side inner surface 516. The second body cooling chamber 304B extends at least partially between the pressure side and suction side inner surfaces 514, 516, in a span-wise direction along the axial length 126. In the illustrated embodiment, the second body cooling chamber 304B is a single chamber that is elongated and extends between the pressure side and suction side inner surfaces 514, 516 from a location close to the leading edge 118 to a location close to the trailing edge 120 inside of the airfoil 102. Optionally, the second body cooling chamber 304B may include one or more walls, partitions, or the like, that may separate the second body cooling chamber 304B into plural cooling chambers or channels that may have substantially uniform or non-uniform shapes and/or sizes (e.g., illustrated in FIG. 13). Optionally, the first and/or second body cooling chambers 304A, 304B may include any number of walls or partitions that may separate the first and/or the second body cooling chambers 304A, 304B include plural cooling chambers or channels that may have substantially uniform or non-uniform shapes and/or sizes. For example, the first body cooling chamber 304A may be a single chamber, and the second body cooling chamber 304B may have one or more walls, dividers, partitions, or the like. Optionally, the first and/or second body cooling chambers 304A, 304B may have any alternative configuration.

The second body cooling chamber 304B is fluidly coupled with the first body cooling chamber 304A with one or more body coolant channels 314 that extend between the first and second body cooling chambers 304A, 304B. In the illustrated embodiment, the body coolant channels 314 are positioned inside of the airfoil 102 in a pattern configuration in a span-wise direction along the axial length 126. Optionally, the body coolant channels 314 may be positioned in any patterned or random configuration at any location inside of the airfoil 102. For example, the airfoil 102 may include plural body coolant channels 314 disposed at a position proximate to the leading edge 118 relative to the trailing edge 120, the airfoil 102 may include plural body coolant channels 314 disposed at a position proximate to the suction side 116 relative to the pressure side 114, or any combination therein. The body coolant channels 314 may be disposed at any location inside of the airfoil 102 and have variations in orientation, shape, and diameter, such as, for example, circular, oval, elliptical, frustroconical, rectangular, or angular, in order to control the direction, the pressure, the amount (e.g., volume), or the like, of the coolant that is directed into the second body cooling chamber 304B from the first body cooling chamber 304A (of FIG. 3) in order to control the temperature of one or more surfaces inside of the airfoil 102.

Figure 6:
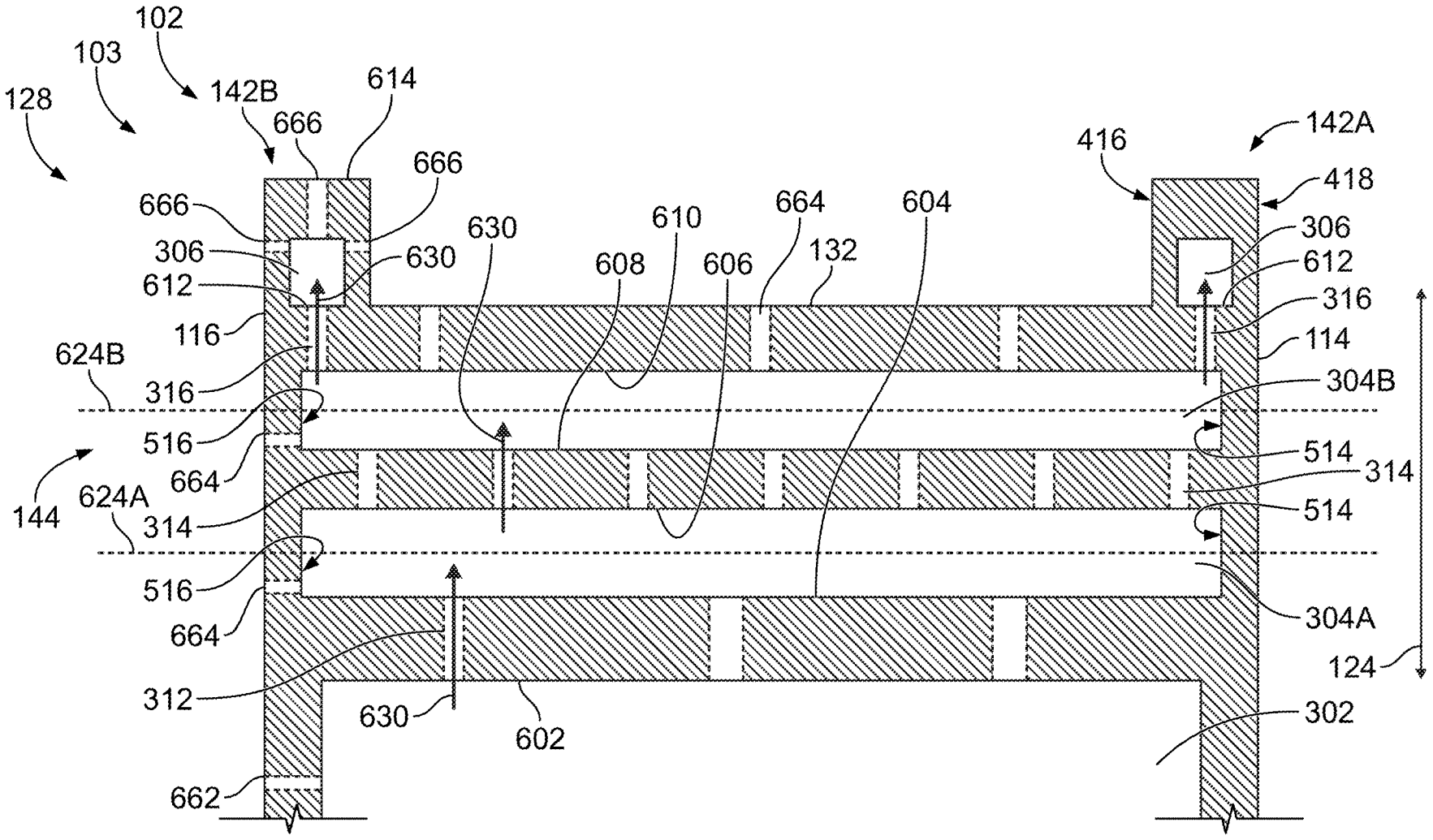
FIG. 6 illustrates a cross-sectional front view of an airfoil in accordance with one embodiment.

FIG. 6 illustrates a partial cross-sectional front view of the cooling assembly 103 of section 3, 6-12-3, 6-12 of the airfoil 102 of FIG. 2. The coolant source chamber 302 is fluidly coupled with the first body cooling chamber 304A via the one or more the source coolant channels 312. For example, the source coolant channels 312 are passages or conduits that extend between a first surface 602 of the coolant source chamber 302 and a first surface 604 of the first body cooling chamber 304A. The coolant source chamber 302 directs at least some of the coolant 630 from inside of the coolant source chamber 302 into the first body cooling chamber 304A through the source coolant channels 312. In the illustrated embodiment, three source coolant channels 312 fluidly couple the coolant source chamber 302 with the first body cooling chamber 304A and a substantially uniform volume of coolant 630 is directed through each of the three source coolant channels 312. Optionally, any number of source coolant channels 312 may fluidly couple the coolant source chamber 302 with the first body cooling chamber 304A and the source coolant channels 312 may direct a substantially uniform or non-uniform volume of coolant 630 through each of the three source coolant channels 312.

The first body cooling chamber 304A is fluidly coupled with the second body cooling chamber 304B via the one or more body coolant channels 314. For example, the body coolant channels 314 are passages or conduits that extend between a second surface 606 of the first body cooling chamber 304A and a first surface 608 of the second body cooling chamber 304B. The first body cooling chamber 304A directs at least some of the coolant 630 from inside the first body cooling chamber 304A into the second body cooling chamber 304B through the body coolant channels 314. In the illustrated embodiment, seven body coolant channels 314 fluidly couple the first and second body cooling chambers 304A, 304B and a substantially uniform volume of coolant 630 is directed through each of the seven body coolant channels 314. Optionally, any number of body coolant channels 314 may fluidly couple the first and second body cooling chambers 304A, 304B and the body coolant channels 314 may direct a substantially uniform or non-uniform volume of coolant 630 through each of the body coolant channels 314.

The second body cooling chamber 304B is fluidly coupled with the rail cooling chamber 306 via the one or more rail coolant channels 316. For example, the rail coolant channels 316 are passages or conduits that extend between a second surface 610 of the second body cooling chamber 304B and a first surface 612 of the rail cooling chamber 306. The second body cooling chamber 304B directs at least some of the coolant 630 from inside the second body cooling chamber 304B into the rail cooling chamber 306 through the rail coolant channels 316. In the illustrated embodiment, two rail coolant channels 316 fluidly couple the second body cooling chamber 304B with the rail cooling chamber 306. A substantially uniform volume of coolant 630 is directed through each of rail coolant channels 316. For example, the rail coolant channels 316 fluidly couple the second body cooling chamber 304B with the rail cooling chamber 306 inside the pressure side tip rail 142A and inside the suction side tip rail 142B. Optionally, the rail coolant channels 316 may fluidly couple the second body cooling chamber 304B with the rail cooling chamber 306 inside the pressure side tip rail 142A, and may not fluidly couple the second body cooling chamber 304B with the rail cooling chamber 306 inside the suction side tip rail 142B, or any combination therein. The rail coolant channels 316 may have variations in orientation, shape, diameter, or the like, such as, for example, circular, oval, elliptical, frustroconical, rectangular, or angular, in order to control the direction, the pressure, the amount (e.g., the volume), or the like, of the coolant that is directed into the rail cooling chamber 306.

The first and second body cooling chambers 304A, 304B are elongated between the pressure side inner surface 514 and the suction side inner surface 516 of the airfoil. In the illustrated embodiment, the first and second body cooling chambers 304A, 304B are single chambers that are elongated between the pressure side and suction side inner surfaces 514, 516. Optionally, one or more of the first or second body cooling chambers 304A, 304B may be elongated only partially between the pressure side and suction side inner surfaces 514, 516.

The first body cooling chamber 304A is elongated along and encompasses at least a part of a first axis 624A between the pressure side and suction side inner surfaces 514, 516. Additionally, the second body cooling chamber 304B is elongated along and encompasses at least a part of a second axis 624B between the pressure side and suction side inner surfaces 514, 516. In the illustrated embodiment, the first axis 624A of the first body cooling chamber 304A and the second axis 624B of the second body cooling chamber 304B are parallel. Optionally, the first and second axis 624A, 624B may be oblique, or the like, to each other. Additionally, the first axis 624A extend in a direction that is substantially perpendicular to the radial length of the airfoil 102 and the second axis 624B extend in a direction that is also substantially perpendicular to the radial length of the airfoil 102. Optionally, one or more of the first or second axis 624A, 624B may extend in any alternative direction such that one or more of the first or second axis 624A, 624B are not perpendicular to the radial length of the airfoil 102. Optionally, one or more of the first or second body cooling chambers 304A, 304B may be elongated along and encompass a different axis that is not perpendicular to the radial length 124. For example, the first and/or second body cooling chambers 304A, 304B may be elongated along a different axis that is substantially parallel with the radial length 124.

Optionally, at least portions of one or more of the first or second body cooling chambers 304A, 304B may be elongated along and encompass a plurality of axes or surfaces that are not perpendicular to the radial length 124. For example, at least portions of the first and/or second cooling chambers 304A, 304B may have an oval, chevron, hourglass, diamond, sinusoidal or wavy, saw tooth, or any alternative non-rectangular shaped cross-section.

In one or more embodiments, the cooling assembly 103 may include one or more exhaust channels that direct at least some of the coolant out of the airfoil 102. For example, one or more exhaust channels may be fluidly coupled with one or more of the rail cooling chamber 306, the first body cooling chamber 304A, the second body cooling chamber 304B, or the coolant source chamber 302 to direct coolant out of the airfoil 102. The exhaust channels may also be referred to herein as source exhaust channels 662, body exhaust channels 664, or rail exhaust channels 666. The source exhaust channels 662 may direct some coolant 630 out of the coolant source chamber 302 through the source exhaust holes 112*e* of FIG. 2 along the pressure and/or suction side 114, 116 of the airfoil 102. The body exhaust channels 664 may direct some coolant 630 out of the first and/or second body cooling chambers 304A, 304B through the body exhaust holes 112*d* of FIG. 2 along the pressure and/or suction side 114, 116 of the airfoil 102. The body exhaust channels 664 may direct some coolant 630 out of the second body cooling chamber 304B through the tip floor exhaust holes 112*f* of FIG. 2 of the airfoil. The rail exhaust channels 666 may direct some coolant 630 out of the rail cooling chamber through the rail exhaust holes 112*a* along a top surface 614 of the tip rail 142, through the rail exhaust holes 112*b* along the rail inner surface 416, and/or through the rail exhaust holes 112*c* along the rail outer surface 418. One or more exhaust holes or channels 112*a*, 112*b*, 112*c*, 112*d*, 112*e*, 112*f* may have variations in orientation, shape, diameter, or the like, such as, for example, circular, oval, elliptical, frustroconical, rectangular, angular, or any combination therein in order to control the direction, the pressure, the amount (e.g., volume), or the like, of the coolant that is exhausted out of the airfoil.

In the illustrated embodiment, the cooling assembly 103 includes a source exhaust channel 662, two body exhaust channels 664, and three rail exhaust channels 666 that direct coolant out of the airfoil 102 along the suction side 116 and along the suction side tip rail 142B of the airfoil 102. Optionally, the cooling assembly 103 may include any number of source exhaust channels 662, body exhaust channels 664, and/or rail exhaust channels 666 that may direct coolant out of the airfoil 102 along any exterior surface of the airfoil 102. Optionally, the cooling assembly 103 may be devoid of source exhaust channels, body exhaust channels, and/or rail exhaust channels. Optionally, the cooling assembly 103 may include any number of exhaust channels that may be disposed at any location along the axial length 126 (of FIG. 2) and/or radial length 124 of the airfoil 102 in any random or patterned configuration.

In one or more embodiments, the surfaces 602, 604, 606, 608, 610, 612 that separate chambers 302, 304, 306 of FIGS. 3 through 6 may also be referred to herein as impingement baffles. The coolant 630 is directed through the channels 312, 314, 316 within the impingement baffles and into each of the cooling chambers disposed inside the tip end 128 of the airfoil 102 in order to reduce a temperature of the tip end 128 of the airfoil 102 relative to the airfoil 102 not including the cooling chambers. The impingement baffles may create regions or areas having an amount of heat transfer on opposing walls that is greater relative to the cooling chambers being fluidly coupled with each other by alternative components.

In one or more embodiments, the cooling assembly 103 may include one or more turbulators, pins, any alternative cooling feature, or the like, disposed inside one or more of the first body cooling chamber 304A, inside the second body cooling chamber 304B, or inside the rail cooling chamber 306 (not shown). The turbulators, pins, or the like, may increase an amount of heat transfer inside one or more cooling chambers of the cooling assembly 103 relative to the cooling chambers not including any turbulator, pins, or the like.

Figure 7:
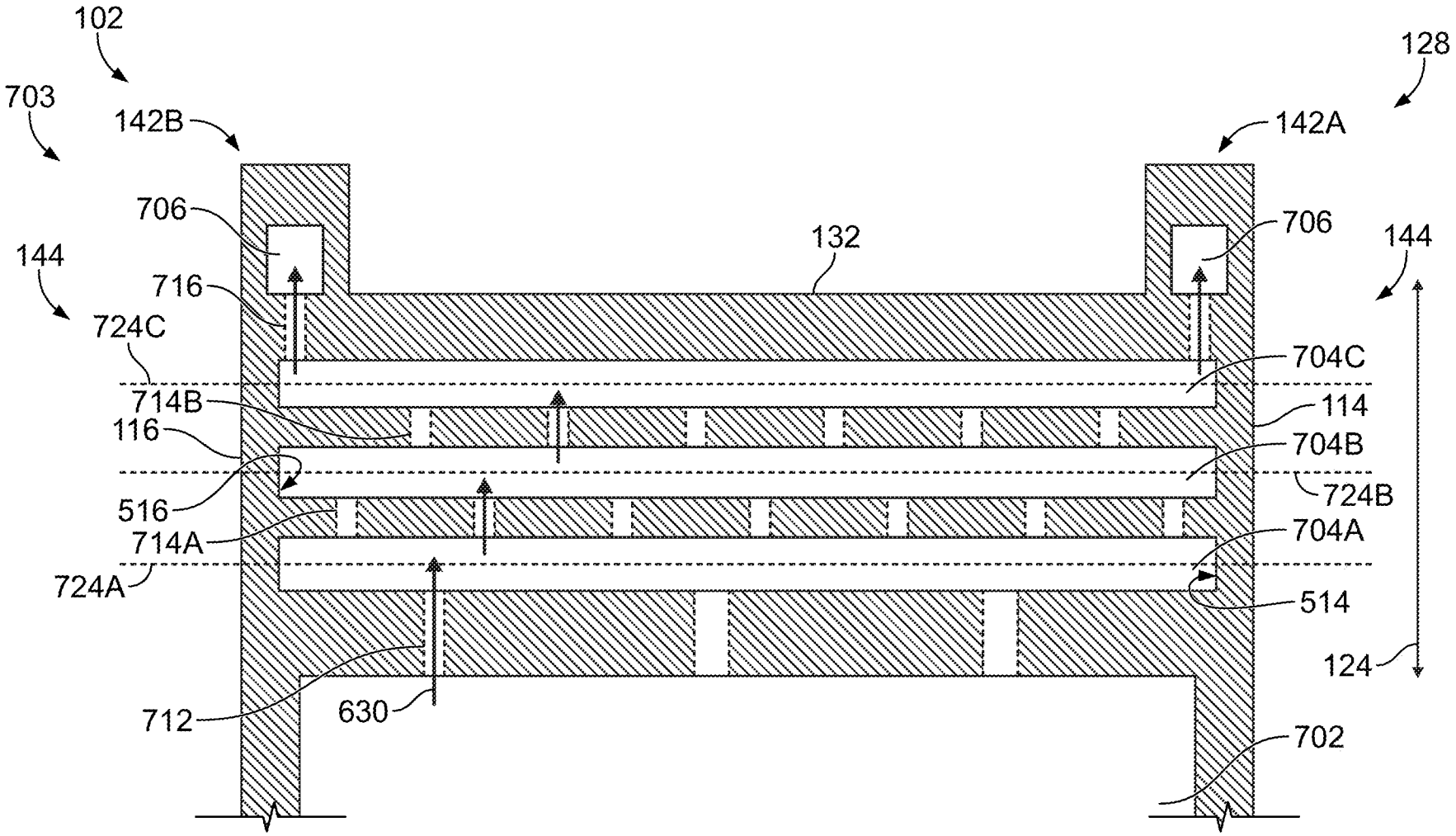
FIG. 7 illustrates a cross-sectional front view of an airfoil in accordance with one embodiment.

FIG. 7 illustrates a partial cross-sectional front view of a cooling assembly 703 of section 3, 6-12-3, 6-12 of the airfoil 102 of FIG. 2 in accordance with one embodiment. The cooling assembly 703 includes a coolant source chamber 702 disposed inside the tip body 144 of the airfoil 102 that is fluidly coupled with a first body cooling chamber 704A via one or more source coolant channels 712. The coolant source chamber 702 directs at least some of the coolant 630 from inside the coolant source chamber 702 into the first body cooling chamber 704A through the source coolant channels 712. The cooling assembly 703 also includes a second body cooling chamber 704B that is disposed inside the tip body 144 of the airfoil 102 and that is fluidly coupled with the first body cooling chamber 704A via one or more first body coolant channels 714A. The first body cooling chamber 704A directs at least some of the coolant 630 from inside the first body cooling chamber 704A into the second body cooling chamber 704B through the first body coolant channels 714A.

The cooling assembly 703 also includes a third body cooling chamber 704C that is disposed inside the tip body 144 of the airfoil 102 and that is fluidly coupled with the second body cooling chamber 704B via one or more second body coolant channels 714B. The second body cooling chamber 704B directs at least some of the coolant 630 from inside the second body cooling chamber 704B into the third body cooling chamber 704C through the second body coolant channels 714B. The cooling assembly 703 also includes a rail cooling chamber 706 that is disposed inside the tip rail 142 of the airfoil 102 and that is fluidly coupled with the third body cooling chamber 704C via one or more rail coolant channels 716. The third body cooling chamber 704C directs at least some of the coolant 630 from inside the third body cooling chamber 704C into the rail cooling chamber 706 through the rail coolant channels 716. Coolant channels 712, 714A, 714B, 716 may have variations in orientation, shape, diameter, or the like, as described above with respect to the coolant channels 312, 314A, 314B, and 316.

The first, second, and third body cooling chambers 704A, 704B, 704C are elongated between the pressure side inner surface 514 and the suction side inner surface 516 of the airfoil. The first body cooling chamber 704A is elongated along and encompasses a first axis 724A between the pressure side and suction side inner surfaces 514, 516. The second body cooling chamber 704B is elongated along and encompasses a second axis 724B between the pressure side and suction side inner surfaces 514, 516. The third body cooling chamber 704C is elongated along and encompasses a third axis 724C between the pressure side and suction side inner surfaces 514, 516. For example, the first axis 724A of the first body cooling chamber 704A, the second axis 724B of the second body cooling chamber 704B, and the third axis 724C of the third body cooling chamber 704C are parallel. Additionally, the first axis 724A extends in a direction that is substantially perpendicular to the radial length 124 of the airfoil 102, the second axis 724B extends in a direction that is also substantially perpendicular to the radial length 124 of the airfoil 102, and the third axis 724C extends in a direction that is also substantially perpendicular to the radial length 124 of the airfoil 102. Optionally, one or more of the first, second, or third axis 724A, 724B, 724C may extend in any alternative direction such that one or more of the first, second, or third axis 724A, 724B, 724C are not perpendicular to the radial length of the airfoil 102. Optionally, at least portions of one or more of the first, second, or third body cooling chambers 704A, 704B, 704C may be elongated along and encompass a plurality of axis or surfaces that are not perpendicular to the radial length 124 as described above with respect to the cooling chambers 304A, 304B.

In the illustrated embodiment, the first, second, and third body cooling chambers 704A, 704C, 704C have substantially uniform shapes and sizes and are elongated between the pressure side inner surface 514 and the suction side inner surface 516. Optionally, one or more of the body cooling chambers 704 may have a unique shape and/or size, such as, for example, oval, chevron, hourglass, diamond, sinusoidal or wavy, saw tooth, or any other non-rectangular cross-sectional shape, may be elongated a distance shorter than between the pressure side and suction side inner surfaces 514, 516, or the like. For example, the first body cooling chamber 704A may have a volume that is greater than or less than a volume of the second and/or third body cooling chambers 704B, 704C. Optionally, the first, second, and third body cooling chambers 704A, 704B, 704C may each have a unique shape, size, and volume relative to the other body cooling chambers 704.

In one or more embodiments, one of the first body cooling chamber 704A, the second body cooling chamber 704B, and/or the third body cooling chamber 704C may be fluidly coupled with one or more of the other first, second, or third body cooling chambers 704A, 704B, 704C. Optionally, one or more of the first, second, or third body cooling chambers 704A, 704B, 704C may be fluidly coupled with the rail cooling chamber 706. Optionally, one or more of the first, second, or third body cooling chambers 704A, 704B, 704C may be fluidly coupled with the coolant source chamber 702. Optionally, any number of body cooling chambers 704 may be fluidly coupled with any number of other body cooling chambers 704, the coolant source chamber 702, and/or the rail cooling chamber 706. Optionally, the cooling assembly 703 may include more than three body cooling chambers 704 fluidly coupled with one or more of the coolant source chamber 702, other body cooling chambers 704, the rail cooling chamber 706, or any combination therein.

In one or more embodiments, the cooling assembly 703 may include one or more exhaust channels that direct at least some of the coolant out of the airfoil 102 (not shown). For example, one or more exhaust channels may be fluidly coupled with one or more of the rail cooling chamber 706, the first body cooling chamber 704A, the second body cooling chamber 704B, the third body cooling chamber 704C, or the coolant source chamber 702, to direct coolant out of the airfoil 102.

Figure 8:
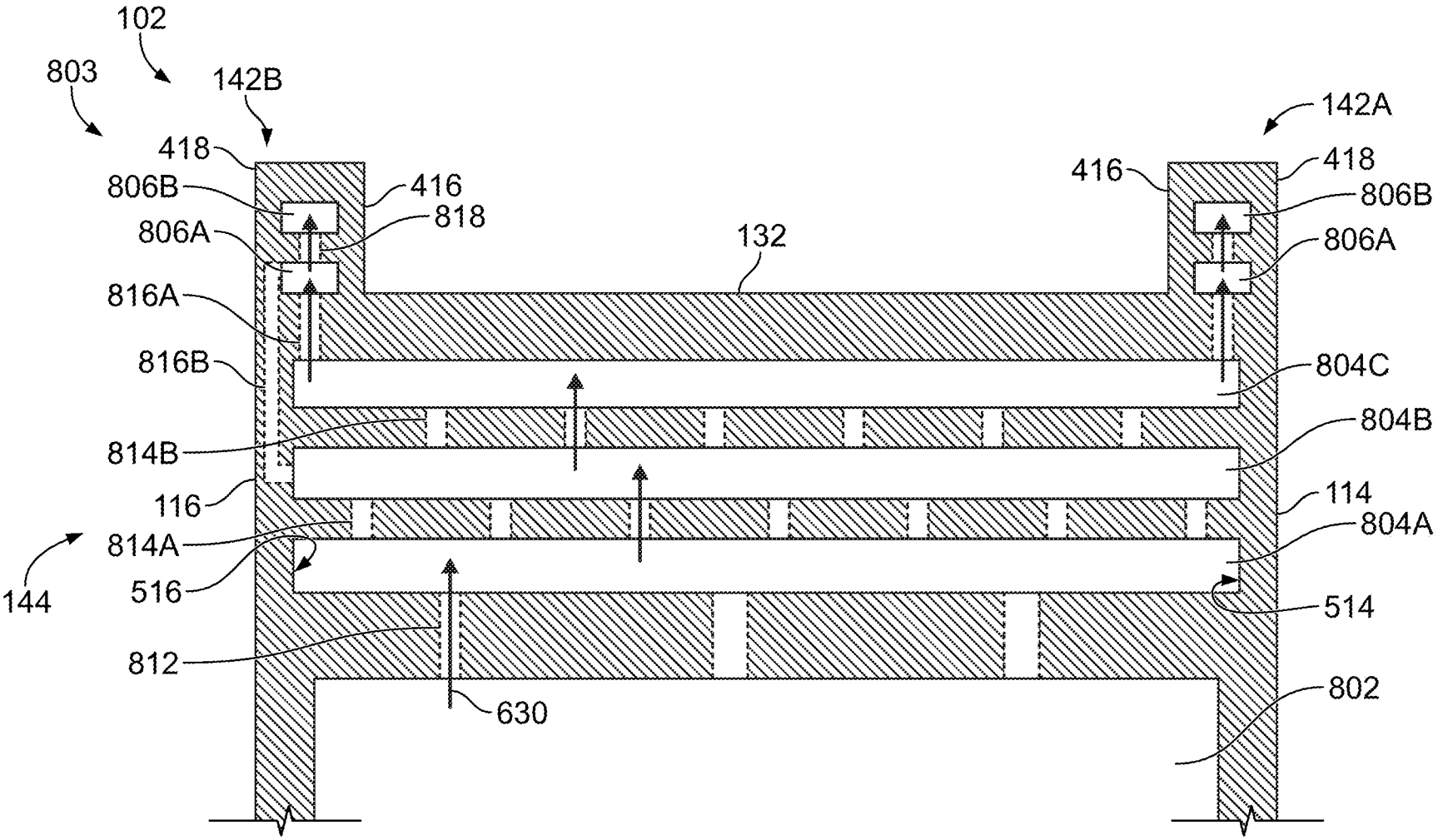
FIG. 8 illustrates a cross-sectional front view of an airfoil in accordance with one embodiment.

FIG. 8 illustrates a partial cross-sectional front view of a cooling assembly 803 of section 3, 6-12-3, 6-12 of the airfoil 102 of FIG. 2 in accordance with one embodiment. The cooling assembly 803 includes a coolant source chamber 802 disposed inside the tip body 144 of the airfoil 102 that is fluidly coupled with a first body cooling chamber 804A via one or more source coolant channels 812. The first body cooling chamber 804A is fluidly coupled with a second body cooling chamber 804B via one or more first body coolant channels 814A, and the second body cooling chamber 804B is fluidly coupled with a third body cooling chamber 804C via one or more second body coolant channels 814B. For example, the coolant 630 is directed from the coolant source chamber 802 into the first body cooling chamber 804A, then into the second body cooling chamber 804B, and then into the third body cooling chamber 804C.

The cooling assembly 803 also includes a first rail cooling chamber 806A disposed inside the tip rail 142 of the airfoil 102 that is fluidly coupled with the third body cooling chamber 804C via one or more first rail coolant channels 816A. The cooling assembly 803 also includes a second rail cooling chamber 806B disposed inside the tip rail 142 of the airfoil 102 that is fluidly coupled with the first rail cooling chamber 806A via one or more second rail coolant channels 818. For example, the coolant 630 is directed from the third body cooling chamber 804C into the first rail cooling chamber 806A then into the second rail cooling chamber 806B.

In the illustrated embodiment, the first and second rail cooling chambers 806A, 806B are each entirely contained within the pressure side tip rail 142A and the suction side tip rail 142B. Additionally, the first and second rail cooling chambers 806A, 806B have substantially uniform shapes, sizes, and volumes, and extend substantially equal distances inside of the tip rail 142 between near the rail inner surface 416 and the rail outer surface 418. Optionally, one or more of the first or second rail cooling chambers 806A, 806B may be contained within the pressure side tip rail 142A and not within the suction side tip rail 142B. Optionally, one or more of the first or second rail cooling chambers 806A, 806B may have a unique shape, size, and/or volume, such as those described above with respect to the rail cooling chambers 306, relative to the other rail cooling chamber. Optionally, the cooling assembly 803 may include more than two rail cooling chambers 806 having any unique and/or common shapes, sizes, configurations, such as those described above with respect to the rail cooling chambers 306.

In one or more embodiments, one or more of the first, second, or third body cooling chambers 804A, 804B, 804C may be fluidly coupled with one or more of the first or second rail cooling chambers 806A, 806B. For example, the second and third body cooling chambers 804B, 804C may both be directly fluidly coupled with the first rail cooling chamber 806A. One or more rail coolant channels 816B may extend between the second body cooling chamber 804B and the first rail cooling chamber 806A, and one or more other rail coolant channels 816A may extend between the third body cooling chamber 804C and the first rail cooling chamber 806A. Optionally, any one or more of the coolant source chamber 802, the body cooling chambers 804, or the rail cooling chambers 806 may be fluidly coupled with any other coolant source chamber 802, body cooling chambers 804, or the rail cooling chambers 806 in any configuration therein.

In one or more embodiments, the cooling assembly 803 may include one or more exhaust channels that direct at least some of the coolant out of the airfoil 102 (not shown). For example, one or more exhaust channels may be fluidly coupled with one or more of the first rail cooling chamber 806A, the second rail cooling chamber 806B, the first body cooling chamber 804A, the second body cooling chamber 804B, the third body cooling chamber 804C, or the coolant source chamber 802, to direct coolant out of the airfoil 102.

The exhaust channels may have any variations in orientations, shape, diameter, or the like, such as those described above with respect to the exhaust holes and channels 112*a*, 112*b*, 112*c*, 112*d*, 112*e*, 112*f*.

Figure 9:
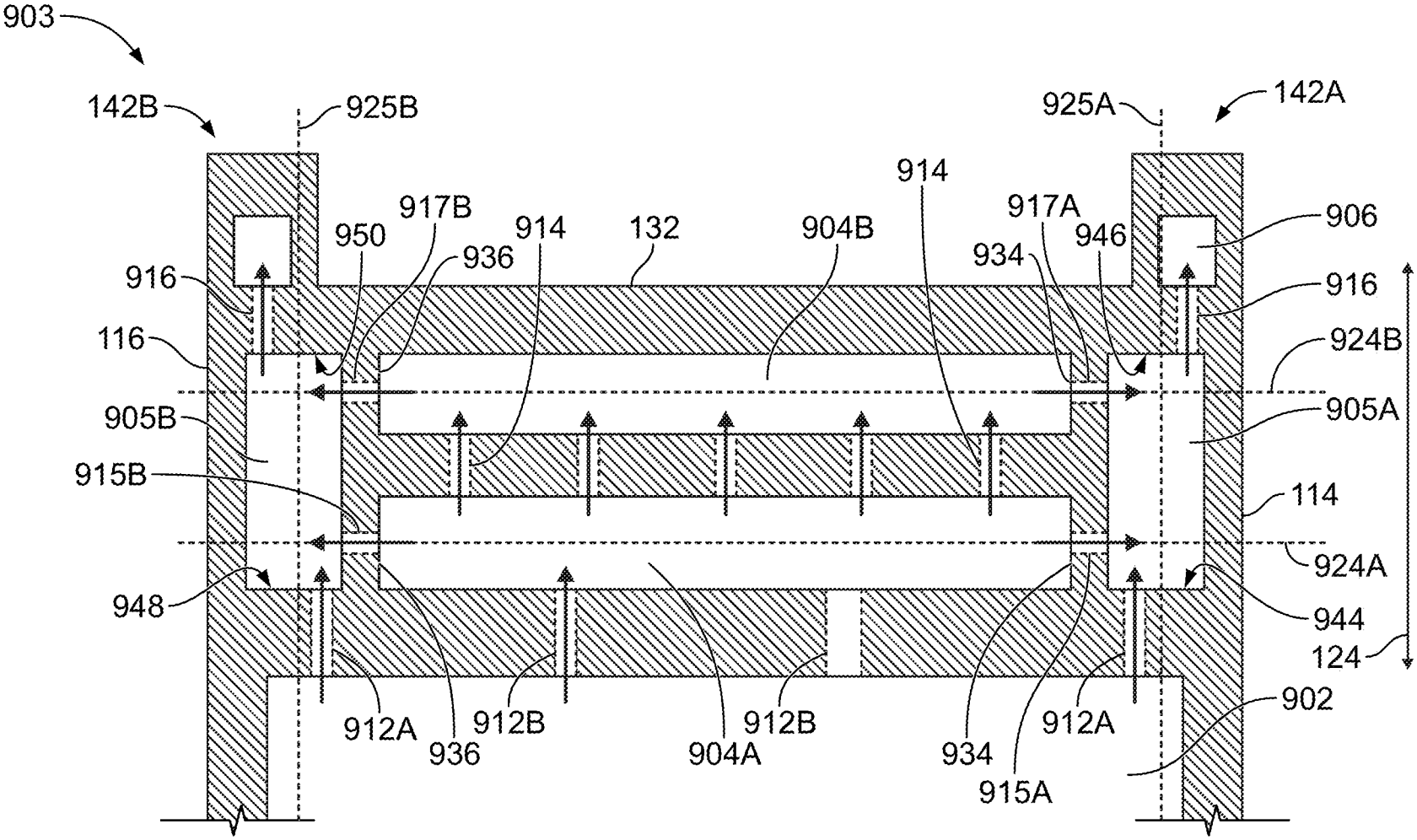
FIG. 9 illustrates a cross-sectional front view of an airfoil in accordance with one embodiment.

FIG. 9 illustrates a partial cross-sectional front view of a cooling assembly 903 of section 3, 6-12-3, 6-12 of the airfoil 102 of FIG. 2 in accordance with one embodiment. The cooling assembly 903 includes a coolant source chamber 902 disposed inside the tip body 144 of the airfoil 102. The coolant source chamber 902 is fluidly coupled with a first body cooling chamber 904A, a pressure side cooling chamber 905A, and a suction side cooling chamber 905B via one or more source coolant channels 912. For example, the coolant source chamber 902 directs some of the coolant 630 into the first body cooling chamber 904A through the source coolant channels 912B, and directs some of the coolant 630 into the pressure side and suction side cooling chambers 905A, 905B through the source coolant channels 912A.

The first body cooling chamber 904A is fluidly coupled with the pressure side cooling chamber 905A, the suction side cooling chamber 905B, and a second body cooling chamber 904B. For example, the first body cooling chamber 904A directs some of the coolant 630 into the pressure side cooling chamber 905A through one or more first pressure channels 915A, directs some of the coolant 630 into the suction side cooling chamber 905B through one or more first suction channels 915B, and directs some of the coolant 630 into the second body cooling chamber 904B through one or more body coolant channels 914.

The second body cooling chamber 904B is also fluidly coupled with the pressure side cooling chamber 905A and the suction side cooling chamber 905B. For example, the second body cooling chamber 904B directs some of the coolant 630 into the pressure side cooling chamber 905A through one or more second pressure channels 917A, and directs some of the coolant 630 into the suction side cooling chamber 905B through one or more second suction channels 917B. In the illustrated embodiment, the first and second body cooling chambers 904A, 904B are each fluidly coupled with the pressure side cooling chamber 905A and fluidly coupled with the suction side cooling chamber 905B. Optionally, one or more of the first or second body cooling chambers 904A, 904B may be fluidly coupled with one or more of the pressure or suction side cooling chambers 905A, 905B in any combination.

The pressure side cooling chamber 905A and the suction side cooling chamber 905B are fluidly coupled with a rail cooling chamber 906. For example, the pressure side cooling chamber 905A directs some of the coolant 630 into the rail cooling chamber 906 disposed inside the pressure side tip rail 142A through one or more rail coolant channels 916, and the suction side cooling chamber 905B directs some of the coolant 630 into the rail cooling chamber 906 disposed inside the suction side tip rail 142B through one or more other rail coolant channels 916.

The first and second body cooling chambers 904A, 904B are elongated between the pressure side cooling chamber 905A and the suction side cooling chamber 905B. For example, the first and second body cooling chambers 904A, 904B are partially elongated between a pressure side inner surface 934 and a suction side inner surface 936 of the airfoil. The first body cooling chamber 904A is elongated along and encompasses a first axis 924A between the pressure side and suction side inner surfaces 934, 936. The second body cooling chamber 904B is elongated along and encompasses a second axis 924B that is substantially parallel with the first axis 924A, between the pressure side and suction side inner surfaces 934, 936. Optionally, the first axis 924A and the second axis 924B may be oblique, or the like, to each other. Additionally, the first axis 924A extends in a direction that is substantially perpendicular to the radial length 124 of the airfoil 102, and the second axis 924B extends in a direction that is also substantially perpendicular to the radial length 124 of the airfoil 102.

Alternatively, the pressure side cooling chamber 905A is elongated between a first surface 944 and an opposite second surface 946, and the suction side cooling chamber 905B is elongated between a first surface 948 and an opposite second surface 950. The pressure side cooling chamber 905A is elongated along and encompasses a pressure axis 925A between the first and second surfaces 944, 946. The suction side cooling chamber 905B is elongated along and encompasses a suction axis 925B between the first and second surfaces 948, 950 wherein the suction axis 925B is substantially parallel with the pressure axis 925A. The pressure axis 925A and the suction axis 925B are substantially parallel with the radial length 124 of the airfoil 102. Additionally, the pressure axis 925A extends in a direction that is substantially perpendicular to the first and second axis 924A, 924B, and the suction axis 925B extends in a direction that is also substantially perpendicular to the first and second axis 924A, 924B.

Optionally, one or more of the first body cooling chamber 904A, the second body cooling chamber 904B, the pressure side cooling chamber 905A, or the suction side cooling chamber 905B may extend between one or more alternative surfaces such that one or more of the first axis 924A, the second axis 924B, the pressure axis 925A, or the suction axis 925B may extend in any alternative direction. For example, the body cooling chambers 904A, 904B, the pressure side cooling chamber 905A, and/or the suction side cooling chamber 905B may have any alternative common or unique shape and/or size, may be elongated along and encompass different axis, or any combination therein. Optionally, at least portions of one or more of the cooling chambers 904A, 904B, 905A, 905B may be elongated along and encompass a plurality of different axis or surfaces that are not perpendicular to the radial length 124 as described above with respect to the cooling chambers 304A, 304B.

In one or more embodiments, the cooling assembly 903 may include one or more exhaust channels that direct at least some of the coolant out of the airfoil 102 (not shown). For example, one or more exhaust channels may be fluidly coupled with one or more of the rail cooling chamber 906, the first body cooling chamber 904A, the second body cooling chamber 904B, the pressure side cooling chamber 905A, the suction side cooling chamber 905B, or the coolant source chamber 902, to direct coolant out of the airfoil 102. The exhaust channels may have any variation in orientation, shape, diameter, or the like, such as those described above with respect to the exhaust holes and channels 112*a*, 112*b*, 112*c*, 112*d*, 112*e*, 112*f*.

Figure 10:
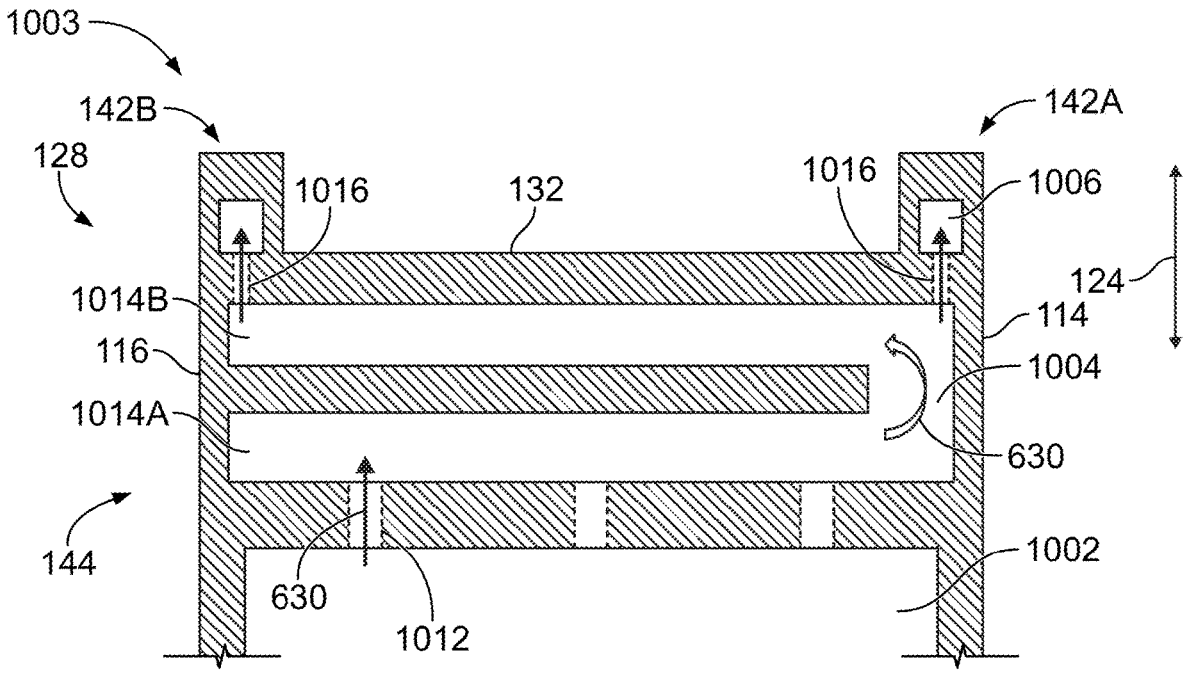
FIG. 10 illustrates a cross-sectional front view of an airfoil in accordance with one embodiment.

FIG. 10 illustrates a partial cross-sectional front view of a cooling assembly 1003 of section 3, 6-12-3, 6-12 of the airfoil 102 of FIG. 2 in accordance with one embodiment. The cooling assembly 1003 includes a coolant source chamber 1002 disposed inside the tip body 144 of the airfoil 102. The coolant source chamber 1002 is fluidly coupled with a serpentine circuit 1004 via one or more source coolant channels 1012. For example, the coolant source chamber 1002 directs some of the coolant 630 into the serpentine circuit 1004 through the source coolant channels 1012.

The serpentine circuit 1004 includes plural coolant passageways 1014 that are fluidly connected in series in a direction along the radial length 124 and are entirely contained inside the tip body 144 of the airfoil 102. In the illustrated embodiment, serpentine circuit 1004 includes two passageways 1014A, 1014B that have substantially common shapes and sizes. Optionally, the circuit 1004 may include any number of passageways 1014, and each passageway may have any common or unique shape and/or size such as, for example, those previously described with respect to the chambers 304. The passageways 1014 extend substantially longitudinally between the pressure side 114 and the suction side 116.

The serpentine circuit 1004 is fluidly coupled with a rail cooling chamber 1006 that is disposed inside the tip rail 142 of the airfoil 102. The serpentine circuit 1004 directs some of the coolant 630 out of the one or more coolant passageways 1014 of the serpentine circuit 1004 into the rail cooling chamber 1006 through one or more rail coolant channels 1016. Optionally, the cooling assembly 1003 may include one or more exhaust channels that direct at least some of the coolant out of the airfoil 102 (not shown). For example, one or more exhaust channels may be fluidly coupled with one or more of the rail cooling chamber 1006, one or more of the coolant passageways 1014 of the serpentine circuit 1004, or the coolant source chamber 1002, to direct coolant out of the airfoil 102. The exhaust channels may have any variation in orientation, shape, diameter, or the like, such as those described above with respect to the exhaust holes and channels 112*a*, 112*b*, 112*c*, 112*d*, 112*e*, 112*f*.

Figure 11:
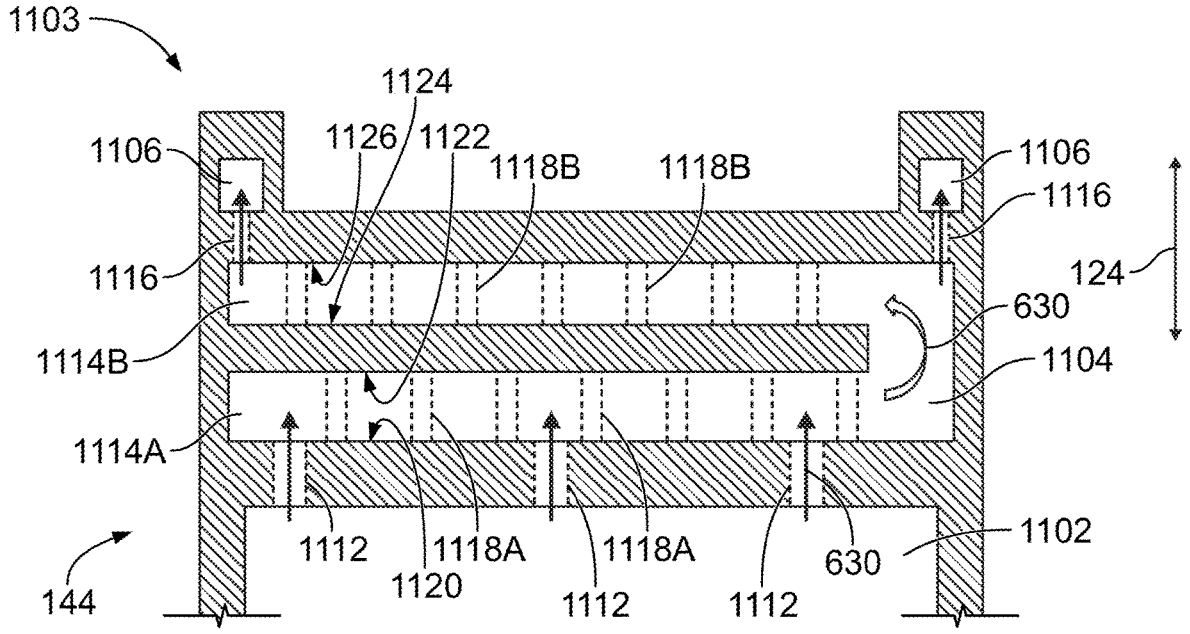
FIG. 11 illustrates a cross-sectional front view of an airfoil in accordance with one embodiment.

FIG. 11 illustrates a partial cross-sectional front view of a cooling assembly 1103 of section 3, 6-12-3, 6-12 of the airfoil 102 of FIG. 2 in accordance with one embodiment. The cooling assembly 1103 includes a coolant source chamber 1102 disposed inside the tip body 144 of the airfoil 102. The coolant source chamber 1102 is fluidly coupled with a serpentine circuit 1104 via one or more source coolant channels 1112. For example, the coolant source chamber 1102 directs some of the coolant 630 out of the coolant source chamber 1102 and into the serpentine circuit 1104 through the source coolant channels 1112. Additionally, the serpentine circuit 1104 is fluidly coupled with a rail cooling chamber 1106 via one or more rail coolant channels 1116. For example, the serpentine circuit 1104 directs some of the coolant 630 out of the serpentine circuit 1104 and into the rail cooling chamber 1106 through the rail coolant channels 1116.

The serpentine circuit 1104 includes two coolant passageways 1114A, 1114B that are fluidly connected in series in a direction along the radial length 124 and are entirely contained inside the tip body 144 of the airfoil 102. The serpentine circuit 1104 includes plural pins 1118 that are disposed along the coolant passageways 1114. The pins 1118 disrupt the flow of the coolant 630 along the passageways 1114 by directing the coolant 630 around the pins 1118. In the illustrated embodiment, a first passageway 1114A includes seven first pins 1118A. Each first pin 1118A extends between a first surface 1120 and an opposite second surface 1122 of the first passageway 1114A. Additionally, a second passageway 1114B includes seven second pins 1118B. Each second pin 1118B extends between a first surface 1124 and an opposite second surface 1126 of the second passageway 1114B. Optionally, the first and/or second passageways 1114A, 1114B may include any number of pins 1118 that may extend completely or partially between any common or alternative unique surfaces. The pins 1118 may increase an amount of heat transfer inside of the passageways 1114 relative to the serpentine circuit 1104 not including any pins 1118. Additionally or alternatively, the first and/or second passageways 1114A, 1114B, and/or the rail cooling chamber 1106 may have any number of pins, turbulators, walls, or the like, that may increase an amount of heat transfer inside of the passageways 1114 or inside the rail cooling chamber 1106 relative to the cooling assembly 1103 not including any pins, turbulators, walls, or the like.

Figure 12:
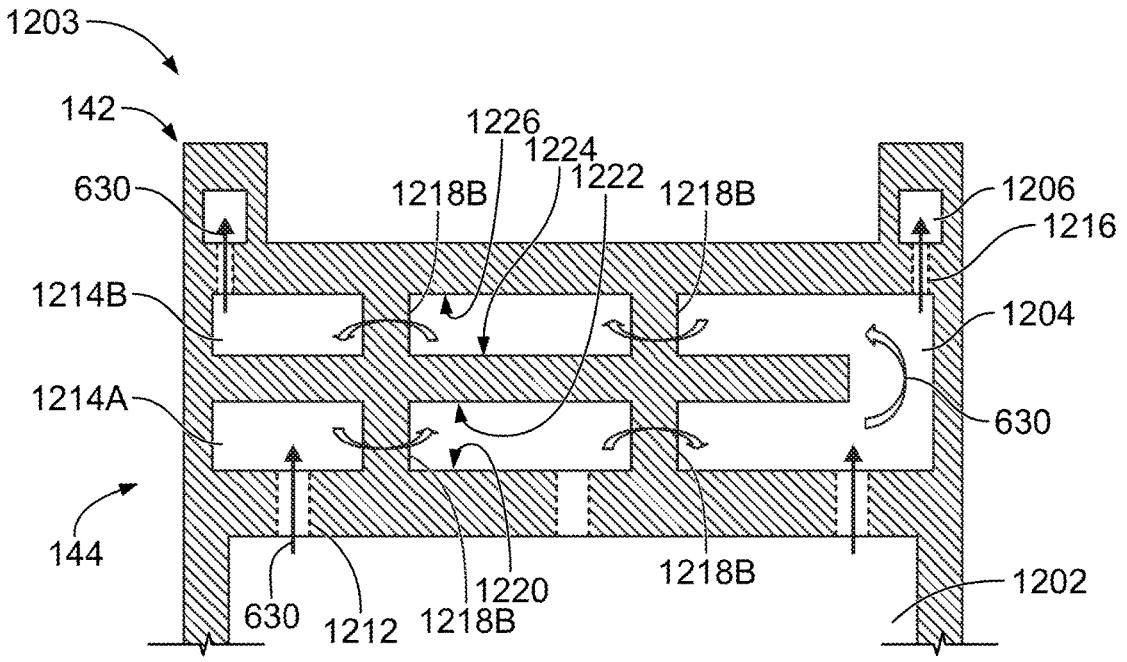
FIG. 12 illustrates a cross-sectional front view of an airfoil in accordance with one embodiment.
Figure 13:
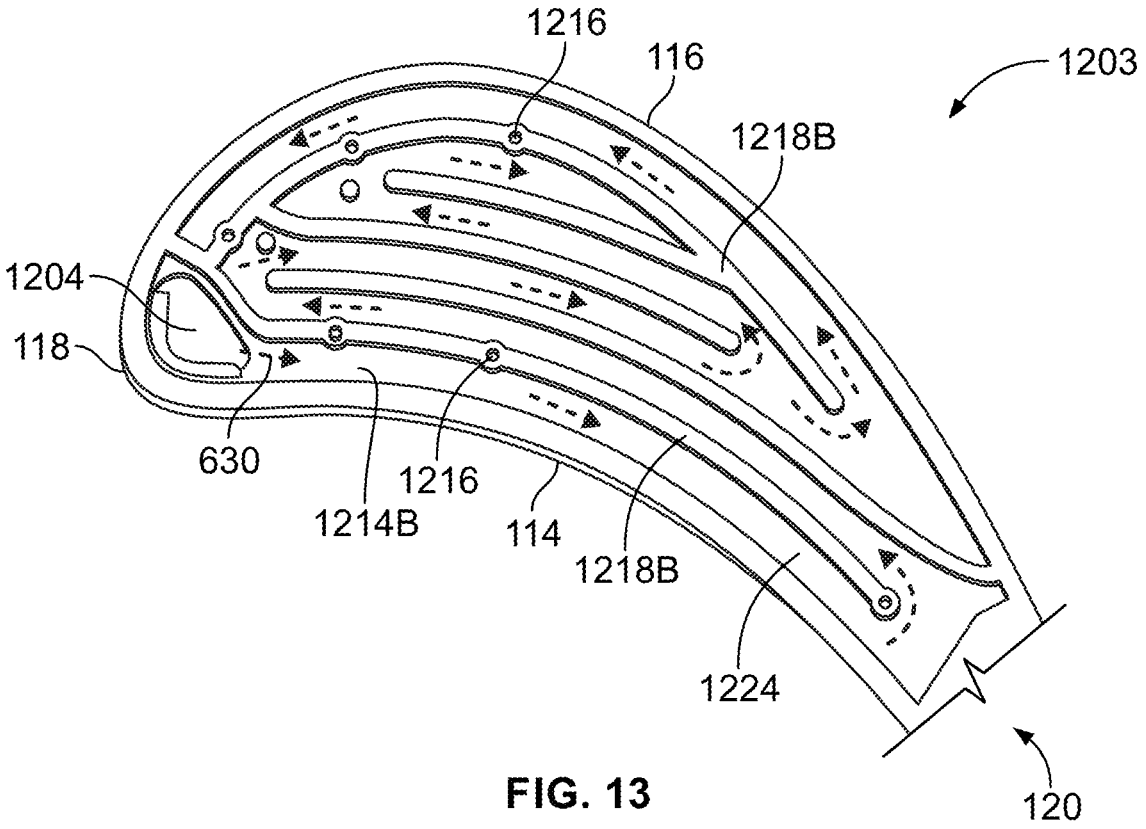
FIG. 13 illustrates a cross-sectional top view of the airfoil of FIG. 12 in accordance with one embodiment.

FIG. 12 illustrates a partial cross-sectional front view of a cooling assembly 1203 of section 3, 6-12-3, 6-12 of the airfoil 102 of FIG. 2 in accordance with one embodiment. FIG. 13 illustrates a cross-sectional top view of the cooling assembly 1203 of section 4-4 of the airfoil 102 of FIG. 2. FIGS. 12 and 13 will be described together herein.

The cooling assembly 1203 includes a coolant source chamber 1202 disposed inside the tip body 144 of the airfoil 102. The coolant source chamber 1202 is fluidly coupled with a serpentine circuit 1204 via one or more source coolant channels 1212. For example, the coolant source chamber 1202 directs some of the coolant 630 out of the coolant source chamber 1202 and into the serpentine circuit 1204 through the source coolant channels 1212. Additionally, the serpentine circuit 1204 is fluidly coupled with a rail cooling chamber 1206 via one or more rail coolant channels 1216. For example, the serpentine circuit 1204 directs some of the coolant 630 out of the serpentine circuit 1204 and into the rail cooling chamber 1206 through the rail coolant channels 1216.

The serpentine circuit 1204 includes two coolant passageways 1214A, 1214B that are fluidly connected to each other in series and are entirely contained inside the tip body 144 of the airfoil 102. The serpentine circuit 1204 includes plural walls 1218 that are disposed along the coolant passageways 1214. The walls 1218 guide the flow of the coolant 630 along the passageways 1214 by directing the coolant 630 back and forth (e.g., into the page and out of the page) around the walls 1218 from the leading edge 118 to the trailing edge 120. In the illustrated embodiment of FIG. 12, a first passageway 1214A includes two walls 1218A, and each wall 1218A extends at least partially between a first surface 1220 and an opposite second surface 1222 of the first passageway 1214A. The walls 1218A disposed inside the first passageway 1214A guide the coolant 630 in a direction around each wall 1218A such that the coolant 630 moves in a back and forth direction along the first passageway 1214A (e.g., out of and then in to the image of FIG. 12) along the serpentine circuit 1204.

Additionally, illustrated in FIGS. 12 and 13, a second passageway 1214B includes plural walls 1218B, and each wall 1218B extends at least partially between a first surface 1224 and an opposite second surface 1226 of the second passageway 1214B. The walls 1218B disposed inside the second passageway 1214B guide the coolant 630 in a direction around each wall 1218B such that the coolant 630 moves in a back and forth direction along the second passageway 1214B (e.g., out of and then in to the image of FIG. 12) along the serpentine circuit 1204. For example, as illustrated in FIG. 13, the walls 1218 may guide the coolant 630 to one or more locations or positions inside of the airfoil in order to manage the temperature of the airfoil 102. Optionally, the first and/or second passageways 1214A, 1214B may include any number of walls 1218 that may direct the coolant 630 in a back and forth direction, or any alternative pattern or random direction along the serpentine circuit 1204.

FIGS. 3 through 13 illustrate seven embodiments of cooling assemblies inside an airfoil 102. Additionally or alternatively, one or more features or components of the cooling assemblies illustrated in FIGS. 3 through 13 may be combined in any combination, configuration, or the like. Optionally, a cooling assembly may have any number of coolant source chambers, body cooling chambers, or rail cooling chambers fluidly coupled with each other in any configuration. Optionally, the coolant source chambers, body cooling chambers, or rail cooling chambers may have any alternative shape, size, orientation, configuration, or the like.

Figure 14:
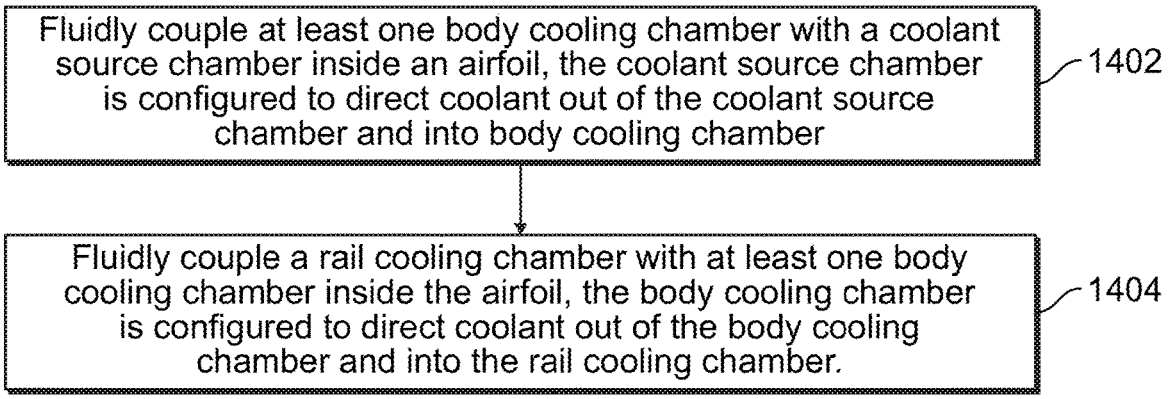
FIG. 14 illustrates a flowchart of a method for cooling an airfoil in accordance with one embodiment.

FIG. 14 illustrates a flowchart of a method 1300 for cooling an airfoil 102 with a cooling assembly (e.g., the cooling assemblies 103, 703, 803, 903, 1003, 1103, or 1203) in accordance with one embodiment. At 1402, a coolant source chamber (e.g., coolant source chamber 302) of the airfoil 102 is fluidly coupled with at least one of two or more body cooling chambers (e.g., first body cooling chamber 304A or second body cooling chamber 304B of FIG. 3) by one or more channels (e.g., the source coolant channels 312). For example, the source coolant channels 312 may be a passage between the coolant source chamber 302 and the first body cooling chamber 304A. Optionally, the coolant source chamber 302 may be fluidly coupled with both the first and second body cooling chambers 304A, 304B, with only the second body cooling chamber 304B, or any combination therein. The coolant source chamber 302 directs at least some coolant from inside the coolant source chamber 302 through the source coolant channels 312 and into the first body cooling chamber 304A and/or the second body cooling chamber 304B that are fluidly coupled with the coolant source chamber 302.

Additionally, the first body cooling chamber 304A is fluidly coupled with the second body cooling chamber 304B. For example, the first body cooling chamber 304A may be fluidly coupled with the second body cooling chamber 304B by one or more body coolant channels 314. The first body cooling chamber 304A directs at least some of the coolant 630 from inside the first body cooling chamber 304A through the one or more body coolant channels 314 and into the second body cooling chamber 304B.

At 1404, at least one of the first or second body cooling chambers 304A, 304B are fluidly coupled with a rail cooling chamber (e.g., rail cooling chamber 306) by one or more channels (e.g., the rail coolant channels 316). For example, the rail coolant channels 316 may be passages between the second body cooling chamber 304B and the rail cooling chamber 306. The rail cooling chamber 306 is disposed inside a tip rail 142 of the airfoil 102. For example, the second body cooling chamber 304B may direct coolant into the rail cooling chamber 306 inside a pressure side tip rail 142A and/or a suction side tip rail 142B of the airfoil 102.

Optionally, one or more of the coolant source chamber 302, the first body cooling chamber 304A, the second body cooling chamber 304B, or the rail cooling chamber 306 may be fluidly coupled with one or more exhaust channels. For example, the exhaust channels may direct coolant out of one or more chambers and outside the airfoil 102. The exhaust channels may direct coolant out of the airfoil onto one or more exterior surfaces of the airfoil such as the pressure side, the suction side, the leading edge, the trailing edge, a rail inner surface, a rail outer surface, a tip floor surface, or any combination therein, in order to change the temperature of the airfoil 102, of one or more interior or exterior surfaces of the airfoil 102, of one or more components of the airfoil 102, or the like.

In one embodiment of the subject matter described herein, a cooling assembly comprises a coolant source chamber disposed inside an airfoil of a turbine assembly. The coolant source chamber is configured to direct coolant inside the airfoil of the turbine assembly. The airfoil extends between a hub end of the airfoil and a tip end of the airfoil along a radial length of the airfoil. The tip end of the airfoil includes a tip body and a tip rail. The cooling assembly includes a first body cooling chamber and a second body cooling chamber disposed inside the tip body of the airfoil. At least a portion of the second body cooling chamber is positioned between the tip end and the first body cooling chamber along the radial length of the airfoil. At least one of the first or second body cooling chambers are fluidly coupled with the coolant source chamber. The coolant source chamber is configured to direct at least some of the coolant into one or more of the first or second body cooling chambers. The cooling assembly also includes a rail cooling chamber disposed inside of the tip rail of the airfoil. The rail cooling chamber is fluidly coupled with at least one of the first or second body cooling chambers. The at least one of the first or second body cooling chambers is configured to direct at least some of the coolant out of the at least one first or second body cooling chambers and into the rail cooling chamber.

Optionally, the cooling assembly also includes one or more exhaust channels fluidly coupled with one or more of the rail cooling chamber or one or more of the first or second body cooling chambers. The one or more exhaust channels are configured to direct the coolant out of the airfoil.

Optionally, the cooling assembly also includes a pressure side inner surface of the airfoil and a suction side inner surface of the airfoil. The first body cooling chamber and the second body cooling chamber are configured to be elongated at least partially between the pressure side inner surface of the airfoil and the suction side inner surface of the airfoil.

Optionally, the first body cooling chamber is elongated along and encompasses at least part of a first axis and the second body cooling chamber is elongated along and encompasses at least part of a different, second axis. At least a portion of the first axis and at least a portion of the second axis are at least one of substantially parallel or oblique to each other.

Optionally, the first body cooling chamber is elongated along and encompasses at least part of a first axis and the second body cooling chamber is elongated along and encompasses at least part of a different, second axis. The first axis is configured to extend in a direction substantially perpendicular to the radial length of the airfoil, and the second axis is configured to extend in a direction substantially perpendicular to the radial length of the airfoil.

Optionally, the cooling assembly also includes one or more of plural pins or plural turbulators disposed inside at least one of the first or second body cooling chambers. The one or more of the plural pins or the plural turbulators are configured to direct the coolant around the plural pins or the plural turbulators inside the at least one of the first or second body cooling chambers.

Optionally, the cooling assembly also includes plural walls disposed inside at least one of the first or second body cooling chambers. The plural walls are configured to direct the coolant around the plural walls inside the at least one of the first or second body cooling chambers.

Optionally, the cooling assembly also includes two or more rail cooling chambers disposed inside the tip rail of the airfoil. At least one rail cooling chamber of the two or more rail cooling chambers is fluidly coupled with at least one other rail cooling chamber.

Optionally, the cooling assembly also includes three or more body cooling chambers disposed inside the tip body of the airfoil. At least one of the three or more body cooling chambers is fluidly coupled with at least one other body cooling chamber.

Optionally, the cooling assembly also includes one or more of an impingement baffle or a serpentine circuit disposed inside the tip body of the airfoil. The first body cooling chamber is fluidly coupled with the second body cooling chamber by the one or more of the impingement baffle or the serpentine circuit.

In one embodiment of the subject matter described herein, a cooling assembly comprises a coolant source chamber disposed inside an airfoil of a turbine assembly. The coolant source chamber is configured to direct coolant inside the airfoil of the turbine assembly. The airfoil extends between a hub end of the airfoil and a tip end of the airfoil along a radial length of the airfoil. The tip end of the airfoil includes a tip body and a tip rail. The cooling assembly includes a first body cooling chamber and a second body cooling chamber disposed inside the tip body of the airfoil. At least a portion of the second body cooling chamber is positioned between the tip end and the first body cooling chamber along the radial length of the airfoil. At least one of the first or second body cooling chambers are fluidly coupled with the coolant source chamber. The coolant source chamber is configured to direct at least some of the coolant into one or more of the first or second body cooling chambers. The cooling assembly also includes a rail cooling chamber disposed inside of the tip rail of the airfoil. The rail cooling chamber is fluidly coupled with at least one of the first or second body cooling chambers. The at least one of the first or second body cooling chambers is configured to direct at least some of the coolant out of the at least one first or second body cooling chambers and into the rail cooling chamber. One or more exhaust channels are fluidly coupled with the one or more of the rail cooling chamber or one or more of the first or second body cooling chambers. The one or more exhaust channels are configured to direct at least some of the coolant out of the airfoil.

Optionally, the cooling assembly also includes a pressure side inner surface of the airfoil and a suction side inner surface of the airfoil. The first body cooling chamber and the second body cooling chamber are configured to be elongated at least partially between the pressure side inner surface of the airfoil and the suction side inner surface of the airfoil.

Optionally, the first body cooling chamber is elongated along and encompasses at least part of a first axis and the second body cooling chamber is elongated along and encompasses at least part of a different, second axis. At least a portion of the first axis and at least a portion of the second axis are at least one of substantially parallel or oblique to each other.

Optionally, the first body cooling chamber is elongated along and encompasses at least part of a first axis and the second body cooling chamber is elongated along and encompasses at least part of a different, second axis. The first axis is configured to extend in a direction substantially perpendicular to the radial length of the airfoil, and the second axis is configured to extend in a direction substantially perpendicular to the radial length of the airfoil.

Optionally, the cooling assembly also includes one or more of plural pins or plural turbulators disposed inside at least one of the first or second body cooling chambers. The one or more of the plural pins or the plural turbulators are configured to direct the coolant around the plural pins or the plural turbulators inside the at least one of the first or second body cooling chambers.

Optionally, the cooling assembly also includes plural walls disposed inside at least one of the first or second body cooling chambers. The plural walls are configured to direct the coolant around the plural walls inside the at least one of the first or second body cooling chambers.

Optionally, the cooling assembly also includes two or more rail cooling chambers disposed inside the tip rail of the airfoil. At least one rail cooling chamber of the two or more rail cooling chambers is fluidly coupled with at least one other rail cooling chamber.

Optionally, the cooling assembly also includes three or more body cooling chambers disposed inside the tip body of the airfoil. At least one of the three or more body cooling chambers is fluidly coupled with at least one other body cooling chamber.

Optionally, the cooling assembly also includes one or more of an impingement baffle or a serpentine circuit disposed inside the tip body of the airfoil. The first body cooling chamber is fluidly coupled with the second body cooling chamber by the one or more of the impingement baffle or the serpentine circuit.

In one embodiment of the subject matter described herein, a method comprises fluidly coupling at least one of a first body cooling chamber or a second body cooling chamber with a coolant source chamber disposed inside the airfoil. The first body cooling chamber and the second body cooling chamber are disposed inside a tip body of the airfoil. The airfoil extends between a hub end of the airfoil and a tip end of the airfoil along a radial length of the airfoil. The tip end of the airfoil includes the tip body and a tip rail. The coolant source chamber is configured to direct coolant out of the coolant source chamber and into the at least one of the first or second body cooling chambers. At least a portion of the second body cooling chamber is positioned between the tip end and the first body cooling chamber along the radial length of the airfoil. The method also includes fluidly coupling a rail cooling chamber disposed inside the tip rail of the airfoil with at least one of the first or second body cooling chambers. The at least one of the first or second body cooling chambers are configured to direct at least some of the coolant out of the first or second body cooling chambers and into the rail cooling chamber.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A cooling assembly comprising:

a coolant source chamber disposed inside an airfoil of a turbine assembly, the coolant source chamber configured to direct coolant inside the airfoil of the turbine assembly, the airfoil including a pressure side wall and a suction side wall, the airfoil configured to extend between a hub end of the airfoil and a tip end of the airfoil along a radial length of the airfoil, the tip end of the airfoil including a tip body and a tip rail;

a first body cooling chamber and a second body cooling chamber disposed inside the tip body of the airfoil, the first body cooling chamber and the second body cooling chamber extending from the pressure side wall to the suction side wall, wherein the second body cooling chamber is positioned between the tip rail and the first body cooling chamber along the radial length of the airfoil, at least one of the first and second body cooling chambers are fluidly coupled with the coolant source chamber, wherein the coolant source chamber is configured to direct at least some of the coolant into one or more of the first and second body cooling chambers; and a rail cooling chamber disposed inside of the tip rail of the airfoil, the rail cooling chamber fluidly coupled with at least one of the first and second body cooling chambers, wherein the at least some of the coolant is directed out of at least one of the first and second body cooling chambers and into the rail cooling chamber.

2. The cooling assembly of claim 1, further including one or more exhaust channels fluidly coupled with at least one of the rail cooling chamber and one or both of the first and second body cooling chambers, wherein the one or more exhaust channels are configured to direct the coolant out of the airfoil.

3. The cooling assembly of claim 1, wherein the first body cooling chamber and the second body cooling chamber are configured to be elongated extending from an inner surface of the pressure side wall of the airfoil to an inner surface of the suction side wall of the airfoil.

4. The cooling assembly of claim 1, wherein the first body cooling chamber is elongated along and encompasses at least part of a first axis and the second body cooling chamber is elongated along and encompasses at least part of a second axis different from the first axis, wherein the first axis and the second axis are either parallel or oblique to each other.

5. The cooling assembly of claim 4, wherein the first axis is configured to extend in a direction perpendicular to the radial length of the airfoil, and wherein the second axis is configured to extend in a direction perpendicular to the radial length of the airfoil.

6. The cooling assembly of claim 1, further including one or both of plural pins and plural turbulators disposed inside at least one of the first and second body cooling chambers, wherein the coolant is directed around the one or both-of the plural pins and the plural turbulators.

7. The cooling assembly of claim 1, further including plural walls disposed inside at least one of the first and second body cooling chambers, wherein the coolant is directed around the plural walls.

8. The cooling assembly of claim 1, wherein the rail cooling chamber is a first rail cooling chamber, and further including a second rail cooling chamber disposed inside the tip rail of the airfoil, wherein the first rail cooling chamber is fluidly coupled with the second rail cooling chamber.

9. The cooling assembly of claim 1, further including a third body cooling chamber disposed inside the tip body of the airfoil, wherein the third body cooling chamber is fluidly coupled with the first and second body cooling chambers.

10. The cooling assembly of claim 1, further including one or both of:

an impingement baffle separating the first body cooling chamber from the second body cooling chamber and fluidly coupling the first body cooling chamber and the second body cooling chamber; and a serpentine circuit formed by a portion of the first body cooling chamber and a portion of the second body cooling chamber.

11. A cooling assembly comprising:

a coolant source chamber disposed inside an airfoil of a turbine assembly, the coolant source chamber configured to direct coolant inside the airfoil of the turbine assembly, the airfoil including a pressure side wall and a suction side wall, the airfoil configured to extend between a hub end of the airfoil and a tip end of the airfoil along a radial length of the airfoil, the tip end of the airfoil including a tip body and a tip rail;

a first body cooling chamber, a second body cooling chamber, and a third body cooling chamber disposed inside the tip body of the airfoil, the first body cooling chamber and the second body cooling chamber longitudinally extending from the pressure side wall to the suction side wall, wherein the second body cooling chamber is positioned between the tip rail and the first body cooling chamber along the radial length of the airfoil, at least one of the first and second body cooling chambers are fluidly coupled with the coolant source chamber, wherein the coolant source chamber is configured to direct at least some of the coolant into the at least one of the first and second body cooling chambers;

a rail cooling chamber disposed inside of the tip rail of the airfoil, the rail cooling chamber fluidly coupled with at least one of the first and second body cooling chambers, wherein at least some of the coolant is directed from the first and second body cooling chambers and into the rail cooling chamber; and one or more exhaust channels fluidly coupled with at least one of the rail cooling chamber and one or both of the first and second body cooling chambers;

wherein the one or more exhaust channels are configured to direct at least some of the coolant out of the airfoil.

12. The cooling assembly of claim 11, further including a pressure side wall inner surface of the airfoil and a suction side wall inner surface of the airfoil, wherein the first and second body cooling chambers are configured to be elongated extending from the pressure side wall inner surface of the airfoil to the suction side wall inner surface of the airfoil.

13. The cooling assembly of claim 11, wherein the first body cooling chamber is elongated along and encompasses at least part of a first axis and the second body cooling chamber is elongated along and encompasses at least part of a second axis different from the first axis, wherein the first axis and the second axis are either parallel or oblique to each other.

14. The cooling assembly of claim 13, wherein the first axis is configured to extend in a direction perpendicular to the radial length of the airfoil, and wherein the second axis is configured to extend in a direction perpendicular to the radial length of the airfoil.

15. The cooling assembly of claim 11, further including one or both of plural pins and plural turbulators disposed inside at least one of the first and second body cooling chambers, wherein the coolant is directed around the one or both of the plural pins and the plural turbulators.

16. The cooling assembly of claim 11, further including plural walls disposed inside at least one of the first and second body cooling chambers, wherein the coolant is directed around the plural walls inside the at least one of the first and second body cooling chambers.

17. The cooling assembly of claim 11, wherein the rail cooling chamber is a first rail cooling chamber, and further including a second rail cooling chamber disposed inside the tip rail of the airfoil, wherein the first rail cooling chamber is fluidly coupled with the second rail cooling chamber.

18. The cooling assembly of claim 11, wherein the third body cooling chamber is fluidly coupled with the first and second body cooling chambers.

19. The cooling assembly of claim 11, further including one or both of:

an impingement baffle separating the first body cooling chamber from the second body cooling chamber and fluidly coupling the first body cooling chamber and the second body cooling chamber; and a serpentine circuit formed by a portion of the first body cooling chamber and a portion of the second body cooling chamber.

20. A method comprising:

fluidly coupling at least one of a first body cooling chamber and a second body cooling chamber with a coolant source chamber disposed inside an airfoil, the first body cooling chamber and the second body cooling chamber disposed inside a tip body of the airfoil, the airfoil including a pressure side wall and a suction side wall, the airfoil configured to extend between a hub end of the airfoil and a tip end of the airfoil along a radial length of the airfoil, the tip end of the airfoil including the tip body and a tip rail, wherein the coolant source chamber is configured to direct coolant out of the coolant source chamber and into the at least one of the first and second body cooling chambers, the second body cooling chamber positioned between the tip rail and the first body cooling chamber along the radial length of the airfoil, the first body cooling chamber and the second body cooling chamber extending from the pressure side wall to the suction side wall; and fluidly coupling a rail cooling chamber disposed inside the tip rail of the airfoil with at least one of the first and second body cooling chambers, wherein at least some of the coolant is directed out of at least one of the first and second body cooling chambers and into the rail cooling chamber.

* * * * *